US012557855B2

(12) United States Patent
Skurla, III et al.

(10) Patent No.: US 12,557,855 B2
(45) Date of Patent: Feb. 24, 2026

(54) GARMENT INCLUDING STRETCH PANELS

(71) Applicant: Acushnet Company, Fairhaven, MA (US)

(72) Inventors: Peter J. Skurla, III, Fairhaven, MA (US); Bethany Rioux, Fairhaven, MA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

(21) Appl. No.: 17/852,236

(22) Filed: Jun. 28, 2022

(65) Prior Publication Data

US 2023/0413925 A1 Dec. 28, 2023

(51) Int. Cl.
*A41B 1/08* (2006.01)
*A41D 31/18* (2019.01)

(52) U.S. Cl.
CPC ..... *A41B 1/08* (2013.01); *A41D 31/18* (2019.02)

(58) Field of Classification Search
CPC .... A41D 31/18; A41D 27/10; A41D 2400/38; A41D 2300/22; A41D 13/0015; A41D 1/04; A41D 19/0089; A41D 13/08; A41B 2400/38; A41B 2300/22; A41B 9/06; A41B 1/00; A41B 7/00; A41C 1/02; A41C 3/08; A41C 3/0057; A41F 19/005
USPC ..... 2/123, 124
See application file for complete search history.

(56) References Cited

U.S. PATENT DOCUMENTS 1,361,565 A * 12/1920 Christy ..... A41D 19/0041 2/160
2,280,479 A * 4/1942 Coben ..... A41D 27/10 2/93
2,434,809 A * 1/1948 Northrup ..... A41D 1/04 2/90
2,643,385 A * 6/1953 Engel ..... A41D 27/10 2/87
2,664,570 A * 1/1954 Artzt ..... A41D 10/00 D2/714
2,702,903 A * 3/1955 Gourdon ..... A41C 1/003 450/130

(Continued)

FOREIGN PATENT DOCUMENTS

DE 202005003978 U1 * 6/2005 ..... A41D 1/02
DE 202009014364 U1 * 3/2010 ..... A41D 27/02

(Continued)

OTHER PUBLICATIONS

Translation of KR 101989483 B1 (Year: 2019).*

(Continued)

*Primary Examiner* — Khoa D Huynh
*Assistant Examiner* — Grady Alexander Nunnery
(74) *Attorney, Agent, or Firm* — Womble Bond Dickinson (US) LLP

(57) ABSTRACT

A garment including at least one stretch panel incorporated into the garment. The garment includes a torso portion having a front and back side, a right sleeve attached to the portion, and a left sleeve attached to the torso portion. The at least one stretch panel includes a stretch panel positioned at least partially on the back side of the torso portion adjacent to where the right or left sleeve is attached to the torso portion, or a stretch panel positioned at least partially on a forearm portion of the right or left sleeve.

13 Claims, 15 Drawing Sheets

(56) References Cited

U.S. PATENT DOCUMENTS

| | | | | |
|---|---|---|---|---|
| 4,369,528 | A * | 1/1983 | Vest | A41D 13/1236 607/108 |
| 4,670,913 | A * | 6/1987 | Morell | A41D 13/02 2/227 |
| 2004/0078865 | A1* | 4/2004 | Culhane | A41D 3/00 2/69 |
| 2005/0210559 | A1* | 9/2005 | Gabriele | A41D 13/0015 2/69 |
| 2010/0130903 | A1 | 5/2010 | Rock | |
| 2010/0299799 | A1* | 12/2010 | Belluye | A41D 13/02 2/243.1 |
| 2014/0033410 | A1* | 2/2014 | Curtis | A41D 13/0002 2/455 |
| 2016/0029702 | A1* | 2/2016 | Griffin | A41D 31/18 2/116 |
| 2019/0133216 | A1* | 5/2019 | Durham | A41D 31/0005 |

FOREIGN PATENT DOCUMENTS

| | | | | |
|---|---|---|---|---|
| DE | 102011083846 | A1 * | 4/2013 | A41D 13/0015 |
| KR | 101243009 | B1 * | 3/2013 | A41D 13/00 |
| KR | 20170079789 | A * | 7/2017 | A41B 13/00 |
| KR | 101989483 | B1 * | 9/2019 | A41C 1/02 |
| WO | WO-2019211693 | A1 * | 11/2019 | A41B 1/08 |

OTHER PUBLICATIONS

Translation of KR-20170079789-A (Year: 2017).*
Translation of DE-202005003978-U1 (Year: 2005).*
Translation of DE-202009014364-U1 (Year: 2010).*
Translation of KR-101243009-B1 (Year: 2013).*
Translation of DE-102011083846-A1 (Year: 2013).*
Extended European Search Report issued in corresponding EP Application No. 23180960.9, dated Oct. 11, 2023, 8 pages.

* cited by examiner

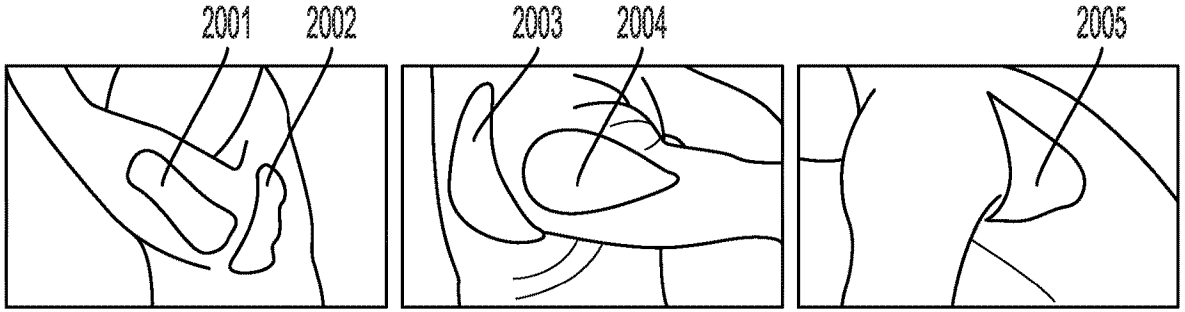
FIG. 7A
FIG. 7B
FIG. 7C
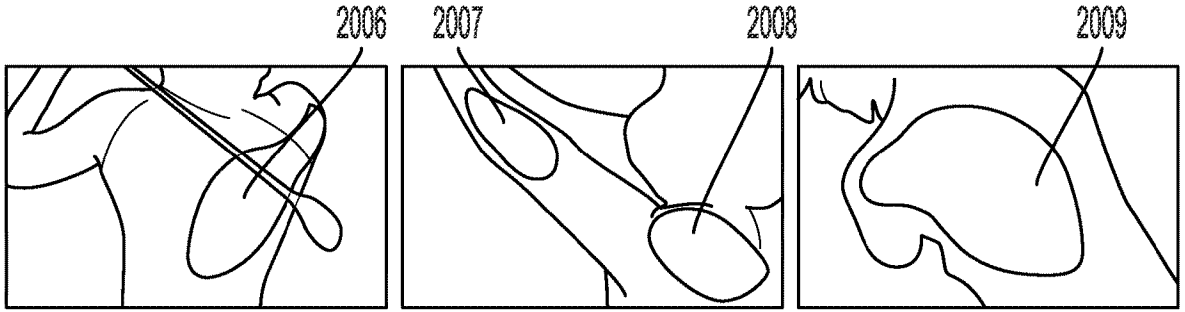
FIG. 7D
FIG. 7E
FIG. 7F
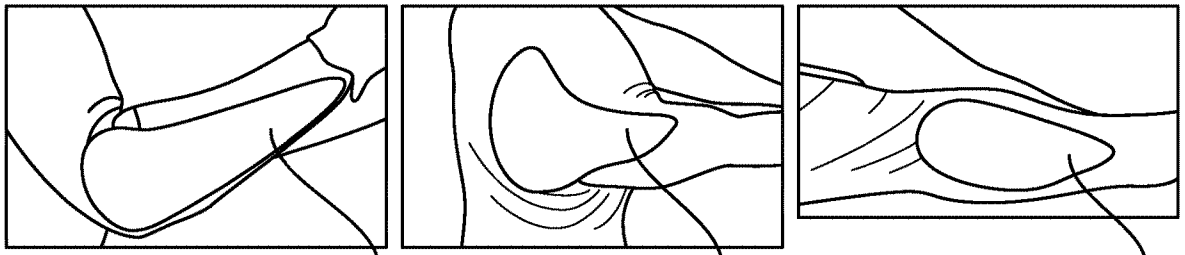
FIG. 7G
FIG. 7H
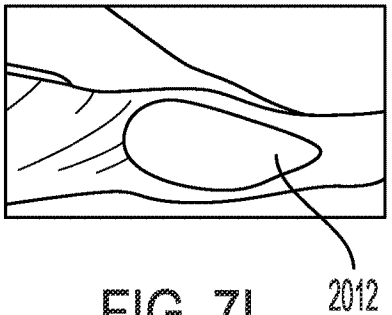
FIG. 7I

GARMENT INCLUDING STRETCH PANELS

BACKGROUND

Active sports such as golf require physical movements from athletes that may be constrained or hindered by the athlete's clothing. For example, while a golfer performs a golf swing, the golfer performs various movements with his arms and torso that cause tension in various regions of the golfer's upper garment. Upper garments typically worn by golfers are not designed to have high stretch properties, and thus, the upper garment may not sufficiently stretch during the golfer's swing to accommodate the golfer's movements. The golfer's swing and performance may be impaired by the garment.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

The technology generally relates to garments including a stretch panel incorporated into the garment.

In an aspect, the technology relates to a garment, including: a torso portion having a front side and a back side, the back side having at least one non-stretch back panel constructed from a first material; a right sleeve attached to the torso portion; a left sleeve attached to the torso portion; and a stretch panel, constructed from a second material having a greater stretch property than the first material, incorporated into the garment and including: a back portion positioned at least partially on the back side of the torso portion adjacent to where the right sleeve is attached to the torso portion, and an extension portion extending from the back portion and onto the front side of the torso portion.

In an example, the extension portion at least partially extends across a part of the torso portion that forms an armpit portion of the garment together with a part of the right sleeve. In another example, an edge of the stretch panel extends from the back side of the torso portion onto the front side of the torso portion along part of a boundary line between the torso portion and the right sleeve. In another example, the back portion of the stretch panel is positioned below, and spaced apart from, a top end of the torso portion. In another example, a maximum height of the back portion of the stretch panel, as measured from a bottom end of the torso portion toward a top end of the torso portion, is 80% to 96% of a maximum longitudinal length between the bottom end and the top end of the torso portion, and the back portion of the stretch panel is spaced apart from the bottom end by a minimum distance of 30% to 45% of the maximum longitudinal length. In another example, a side edge of the stretch panel facing a virtual back longitudinal center line extending along a longitudinal direction, and across a center, of the back side of the torso portion is curved convex towards the virtual back longitudinal center line. In another example, the right sleeve includes an upper arm portion coupled to the torso portion and a forearm portion coupled to the upper arm portion, and wherein the stretch panel is a first stretch panel and the garment further includes a second stretch panel incorporated into the garment, positioned at least partially on the forearm portion, and shaped and sized to extend circumferentially around at least part of the right sleeve. In another example, the stretch panel is a back-right stretch panel and the garment further includes a back-left stretch panel incorporated into the garment, spaced apart from the back-right stretch panel, and including: a back portion positioned at least partially on the back side of the torso portion adjacent to where the left sleeve is attached to the torso portion, and an extension portion extending from the back portion and onto the front side of the torso portion.

In an aspect, the technology relates to a garment, including: a torso portion having a front side and a back side; a right sleeve attached to the torso portion; a left sleeve attached to the torso portion; a back-right stretch panel incorporated into the garment and positioned at least partially on the back side of the torso portion adjacent to where the right sleeve is attached to the torso portion; and a back-left stretch panel incorporated into the garment, positioned at least partially on the back side of the torso portion adjacent to where the left sleeve is attached to the torso portion, and spaced apart from the back-right stretch panel in the garment.

In an example, the back-right and back-left stretch panels are symmetrical with respect to a virtual back longitudinal center line extending along a longitudinal direction, and across a center, of the back side of the torso portion. In another example, the torso portion has a top end defining a boundary between the front and back sides of the torso portion, and each of the back-right and back-left stretch panels are positioned to respectively cover part of the top end. In another example, each of the back-right and back-left stretch panels has a first edge facing, and being curved convex towards, a virtual back longitudinal center line extending along a longitudinal direction, and across a center, of the back side of the torso portion, and wherein a minimum distance between the first edges of the back-right and back-left stretch panels is 10% to 30% of a maximum lateral width between first and second sides of the torso portion. In another example, a bottom end of the torso portion defines a hem having a front portion corresponding to at least part of the front side of the torso portion and having: a first end; a second end; a middle region between the first and second ends; a first intermediate region between the first end and the middle region that extends farther downward along a longitudinal direction, relative to a virtual lateral line positioned on the front side of the torso portion between the bottom end and a top end of the torso portion, than each of the first end and the middle region; and a second intermediate region between the second end and the middle region that extends farther downward along the longitudinal direction, relative to the virtual lateral line, than each of the second end and the middle region.

In an aspect, the technology relates to a garment, including: a torso portion having a front side and a back side; a right sleeve including a right upper arm portion coupled to the torso portion and a right forearm portion coupled to the right upper arm portion; a left sleeve including a left upper arm portion coupled to the torso portion and a left forearm portion coupled to the left upper arm portion; a right-sleeve stretch panel incorporated into the garment, positioned at least partially on the right forearm portion, and shaped and sized to extend circumferentially at least partially around the right sleeve; and a left-sleeve stretch panel incorporated into the garment, positioned at least partially on the left forearm portion, and shaped and sided to extend circumferentially at least partially around the left sleeve.

In an example, the right-sleeve stretch panel has a closed-ribbon shape extending circumferentially entirely around the right sleeve. In another example, the right-sleeve stretch panel has a first edge proximal to the torso portion and extending circumferentially at least partially around the right sleeve and a second edge distal to the torso portion and extending circumferentially at least partially around the right sleeve, and wherein an average width of the right-sleeve stretch panel, as measured along a longitudinal direction of the right sleeve between the first and second edges of the right-sleeve stretch panel, is 10% to 30% of a maximum length of the right sleeve. In another example, at least a portion of the right-sleeve stretch panel extends simultaneously circumferentially around the right sleeve and longitudinally along the right sleeve. In another example, a top line of the right sleeve extends between a distal end of the right sleeve and a top end of the torso portion, a bottom line of the right sleeve extends between the distal end of the right sleeve and a right armpit portion of the garment, and the right-sleeve stretch panel covers a portion of the top line and a portion of the bottom line. In another example, a distance along the top line between the distal end of the right sleeve and the right-sleeve stretch panel is 5% to 15% of a length of the top line, and a distance along the bottom line between the distal end of the right sleeve and the right-sleeve stretch panel is 30% to 40% of a length of the bottom line. In another example, the garment further includes: a back-right stretch panel incorporated into the garment and positioned at least partially on the back side of the torso portion adjacent to where the right sleeve is attached to the torso portion; and a back-left stretch panel incorporated into the garment, positioned at least partially on the back side of the torso portion adjacent to where the left sleeve is attached to the torso portion, and spaced apart from the back-right stretch panel in the garment.

BRIEF DESCRIPTION OF THE DRAWINGS

Non-limiting and non-exhaustive examples are described with reference to the following figures.

FIGS. 7A to 7I depict perspective views of stretched regions of a garment being worn by a player at various times while the player performs golf swings.

DETAILED DESCRIPTION

As briefly discussed above, athletes participating in active sports perform various movements that cause tension in the garments worn by the athlete. Traditional garments use materials, such as woven materials, which have good water-protecting properties but which have poor stretch properties. Accordingly, traditional garments are unable to sufficiently stretch in the regions of tension to accommodate the athlete's movements, and thus, those traditional garments constrain the athlete's movement and impair his or her performance. As an example, in the sport of golf, the golf swing of an athlete requires a wide range of motion, such as motion of the torso and arms, that is hindered or restricted by a traditional woven-fabric garment, such as a traditional rain jacket.

The present technology alleviates the issues discussed above, among others, by incorporating stretch panels into an upper garment at strategically selected regions of the upper garment that have been determined by experimental data to correspond to regions that experience tension during a golf swing. The movements of a golfer wearing an upper garment according to an example of the present disclosure are therefore substantially unconstrained by the upper garment, and the golfer's performance is substantially improved.

Figure 1:
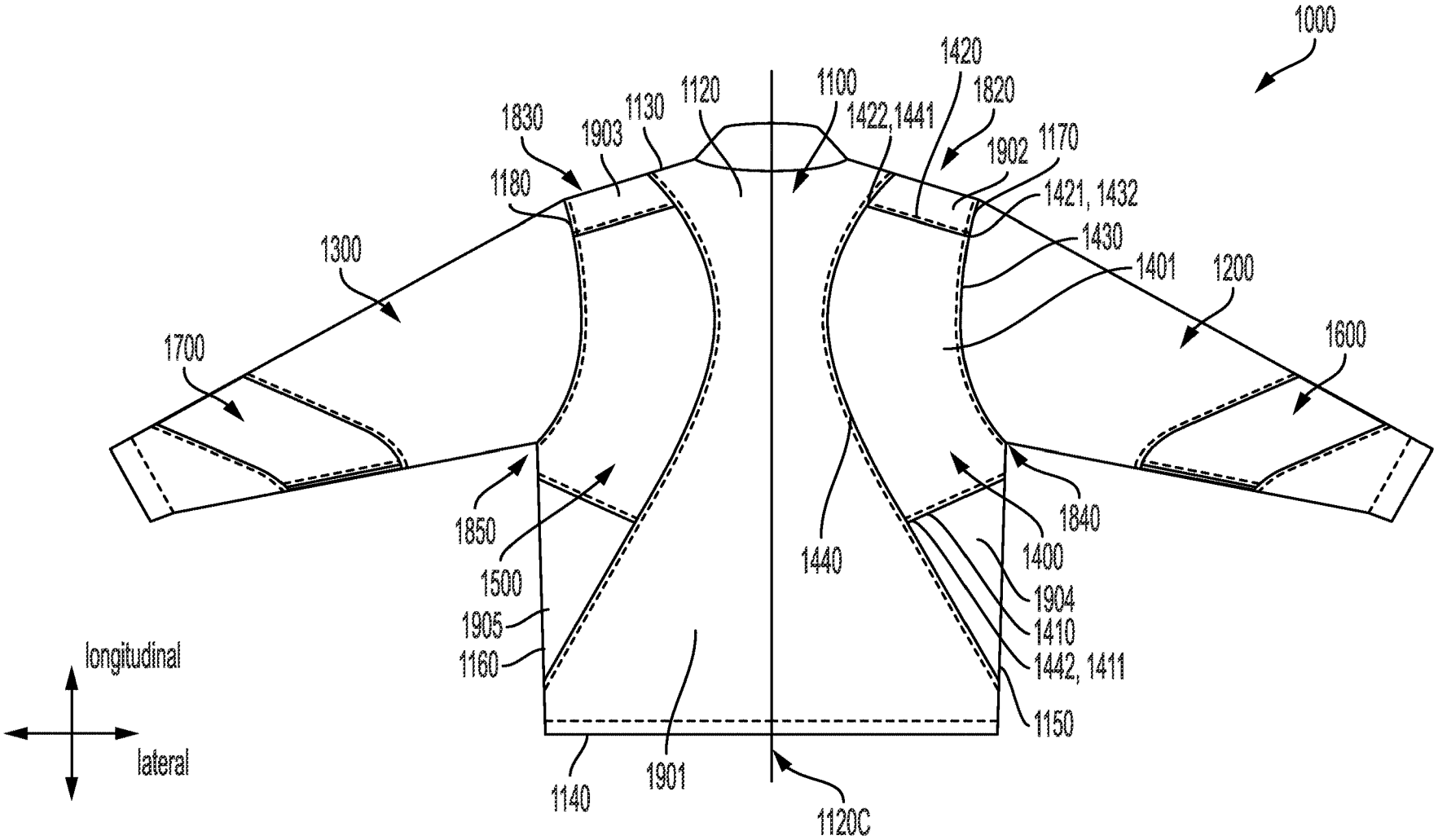
FIG. 1 to FIG. 3 depict a back view of an example garment.
Figure 2:
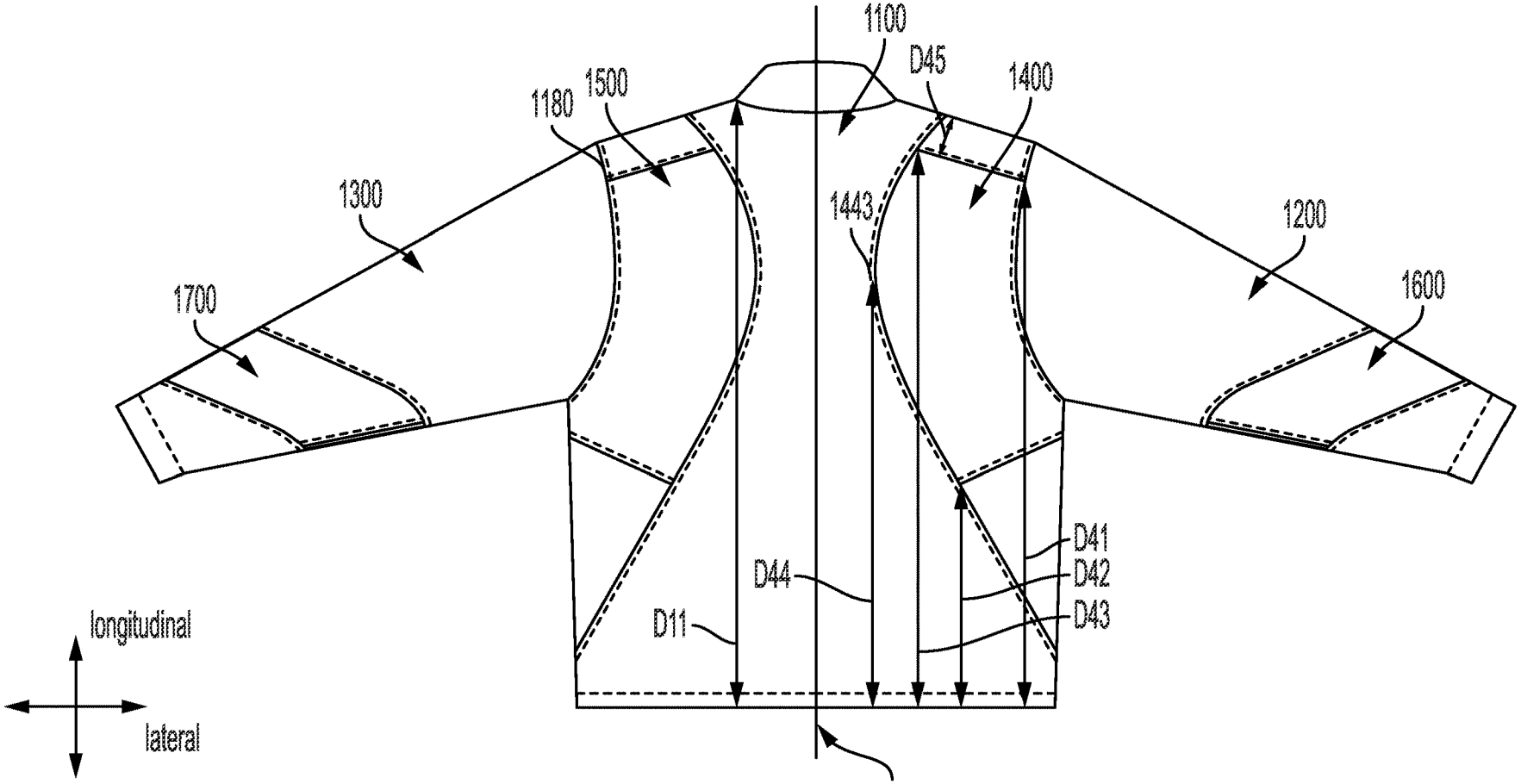
Figure 3:
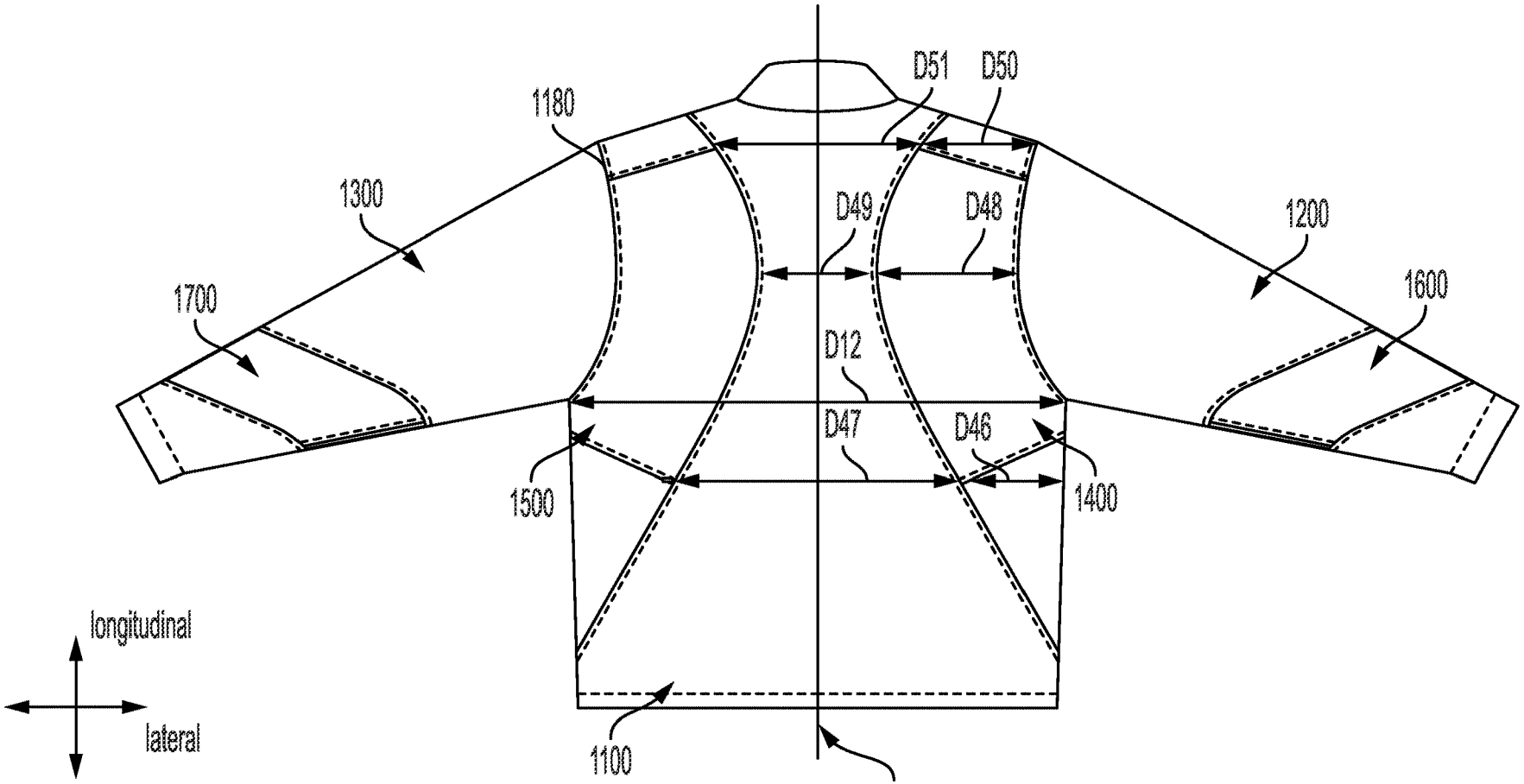
Figure 4:
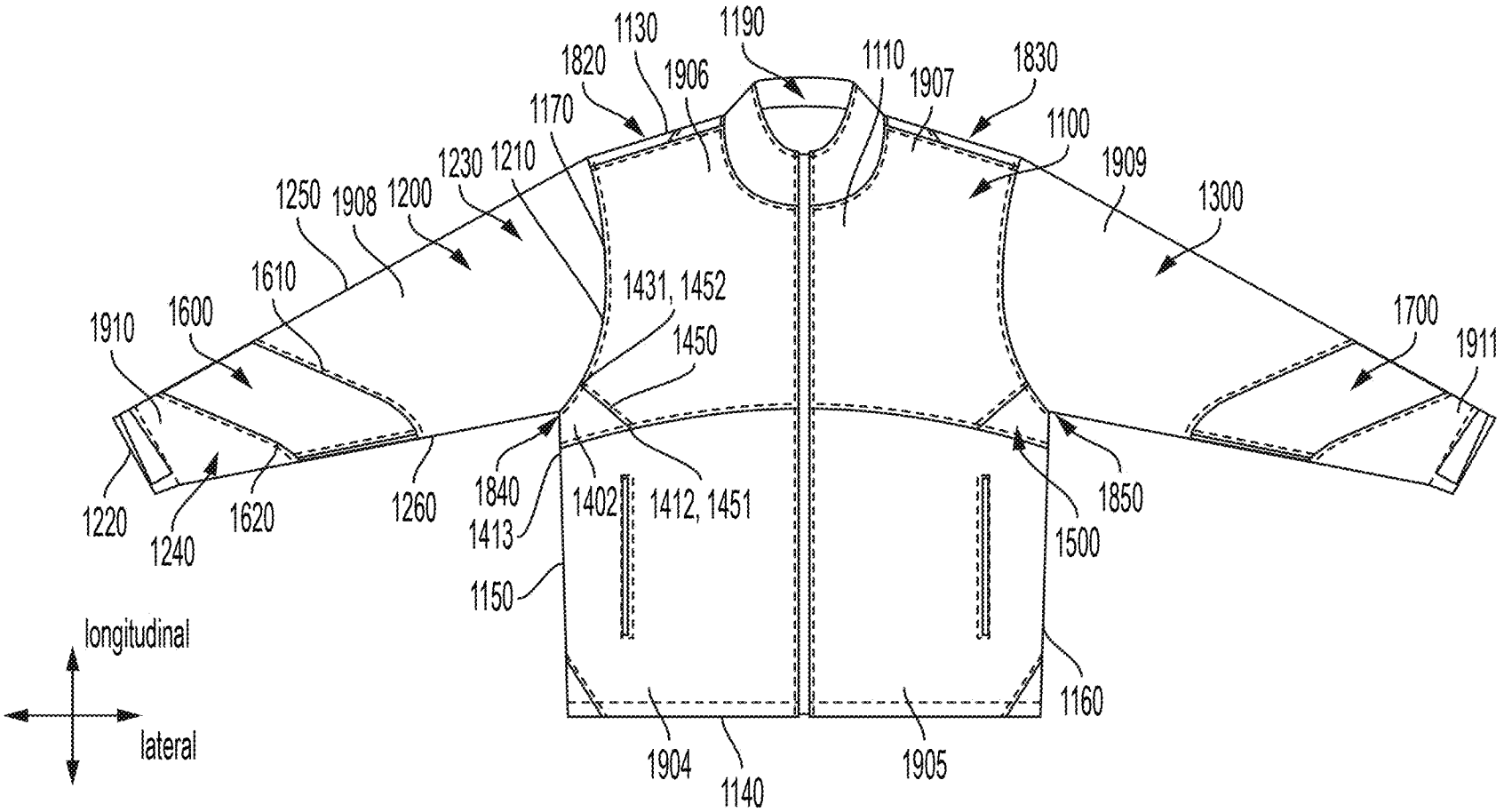
FIG. 4 to FIG. 6 depict a front view of the garment of FIG. 1 to FIG. 3.
Figure 5:
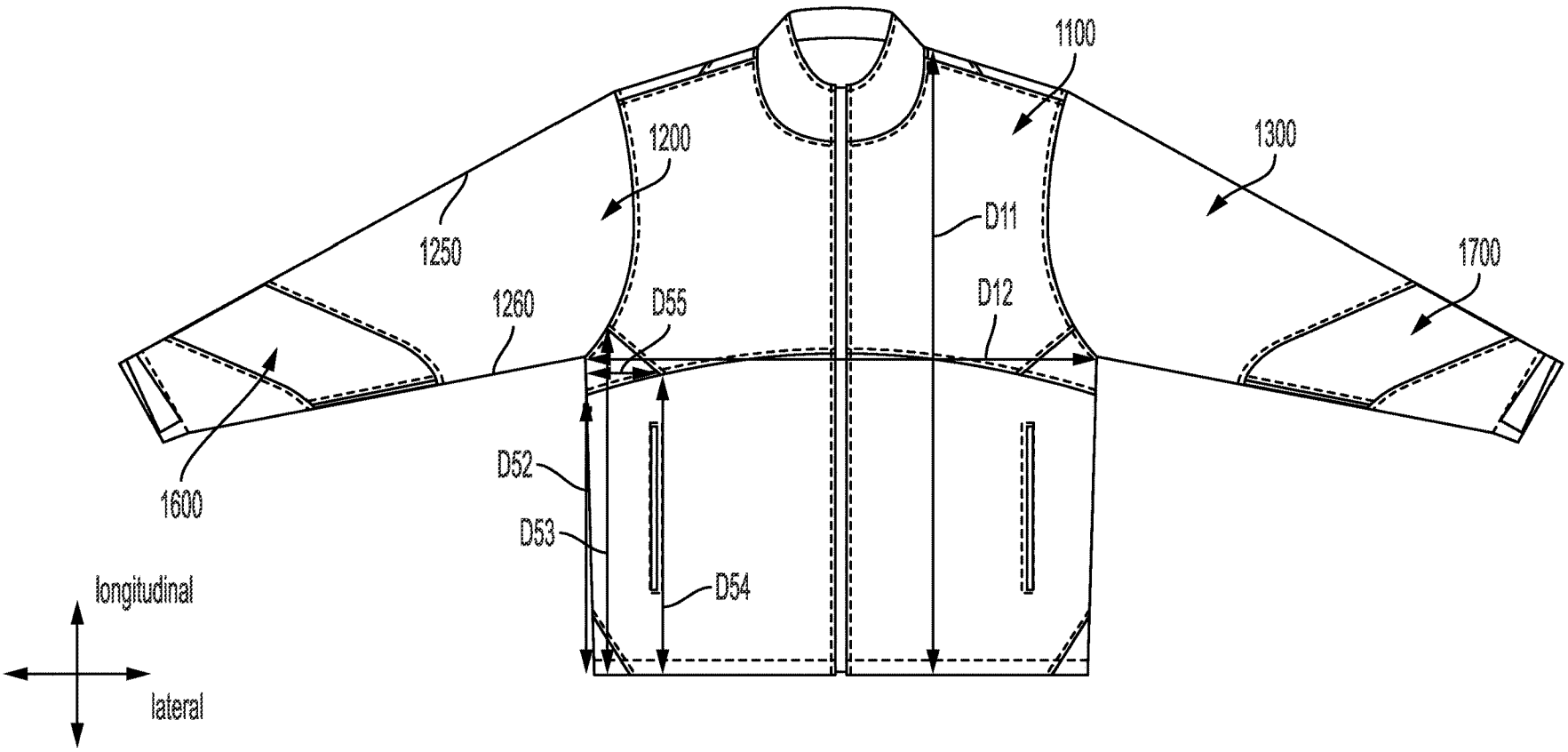
Figure 6:
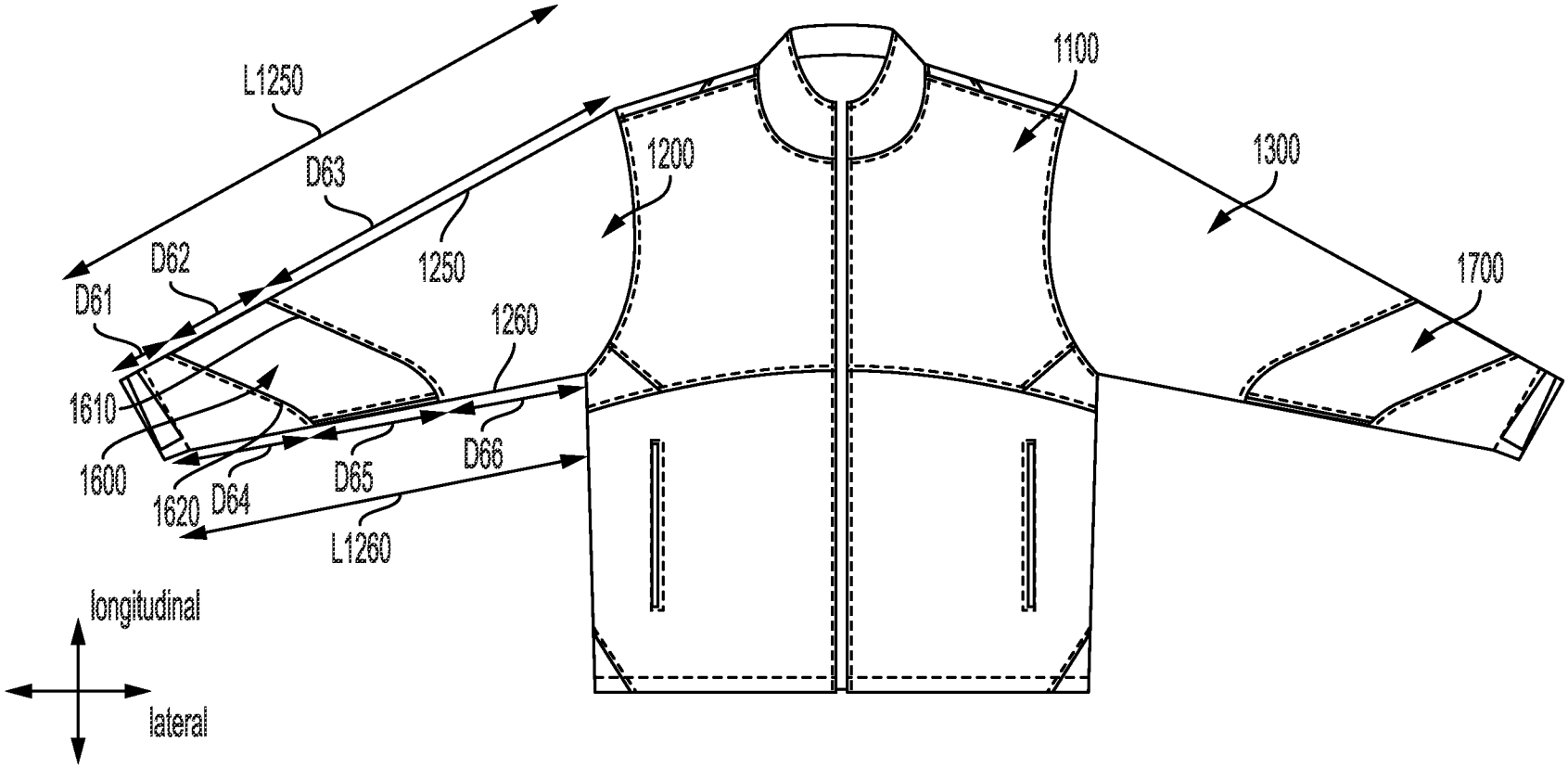

FIG. 1 to FIG. 3 depict back views of an example garment 1000, and FIG. 4 to FIG. 6 depict front views of the garment 1000 of FIG. 1 to FIG. 3. In this example, the garment 1000 includes four stretch panels 1400, 1500, 1600, and 1700 incorporated into the garment 1000. Although the garment 1000 is depicted as being a long-sleeve jacket, examples garments of the present disclosure may be of any suitable type, such as a jacket, long sleeve shirt, short sleeve shirt, no-sleeve shirt, sweater, hoodie, vest, etc., that is able to have incorporated into it at least one stretch panel as described herein. Furthermore, although the garment 1000 is depicted as having a full zipper and two pockets, the present disclosure is not limited thereto, and example garments according to the present disclosure may have no pockets or any suitable number of pockets, and may have a full zipper, no zipper, half zipper, buttons, hook-and-loop fasteners (e.g., Velcro®-brand fasteners), etc.

Although some features of the garment 1000 may be described with reference to a right side or a left side of the garment 1000 for convenience, it will be understood that such descriptions may similarly apply to features on the left side or the right side of the garment 1000, respectively. In some examples, the right and left sides of the garment 1000 are symmetrical.

Referring collectively to FIGS. 1-6, the garment 1000 may include a torso portion 1100, a first sleeve 1200 attached to the torso portion 1100, and a second sleeve 1300 attached to the torso portion 1100. The torso portion 1100 may be adapted to cover at least part of a player's torso, and the first sleeve 1200 and the second sleeve 1300 may be adapted to cover at least part of the player's arms. The first sleeve 1200 may be referred to as a "right sleeve" and the second sleeve 1300 may be referred to as a "left sleeve."

The garment 1000 includes a first stretch panel 1400, a second stretch panel 1500, a third stretch panel 1600, and a fourth stretch panel 1700, which are integrated into the garment 1000. The stretch panels 1400, 1500, 1600, 1700 are made from a material that is different from a material used to form an adjacent portion of the garment 1000. The material of each of the first to fourth stretch panels 1400, 1500, 1600, and 1700 respectively has greater stretch properties than the material of the adjacent portion of the garment 1000. For example, each of the first to fourth stretch panels 1400, 1500, 1600, and 1700 may include knit fabric, while the remainder of the garment 1000 may generally include woven fabric. In some examples, the first to fourth stretch panels 1400, 1500, 1600, and 1700 may be constructed from the same type of material, but the present disclosure is not limited thereto. For example, one of the first to fourth stretch panels 1400, 1500, 1600, and 1700 may be different in material than at least one of the remaining first to fourth stretch panels 1400, 1500, 1600, and 1700.

Each of the first to fourth stretch panels 1400, 1500, 1600, and 1700 may respectively include a material having a higher stretch percentage than a stretch percentage of the adjacent portion of the garment. For example, the stretch percentage of a material of a stretch panel of the first to fourth stretch panels 1400, 1500, 1600, and 1700 may be between 1.5 to 20 times the stretch percentage of a material of the portion of the garment adjacent to the stretch panel. In some examples, a stretch percentage in a lengthwise direction of a material of a stretch panel of the first to fourth stretch panels 1400, 1500, 1600, and 1700 may be 2 to 4 times a stretch percentage in the lengthwise direction of a material of the portion of the garment 1000 adjacent to the stretch panel, and a stretch percentage in a widthwise direction of the material of the stretch panel may be 15 to 20 times a stretch percentage in the widthwise direction of the material of the portion of the garment 1000 adjacent to the stretch panel. In some examples, a material of a stretch panel of the first to fourth stretch panels 1400, 1500, 1600, and 1700 may stretch 15% to 25% in a lengthwise direction, and 120% to 160% in the widthwise direction, more than a material of the portion of the garment 1000 adjacent to the stretch panel stretches. In some examples, the first to fourth stretch panels 1400, 1500, 1600, and 1700 may be knit fabric having a stretch percentage determined according to, for example, the ASTM D2594 test, and the adjacent portions of the garment 1000 may include a woven fabric having a stretch percentage determined according to, for example, the D3107 test. In some examples, a material of a stretch panel of the first to fourth stretch panels 1400, 1500, 1600, and 1700 may stretch by 15% to 45%, 20% to 40%, or 25% to 35% in a lengthwise direction, and may stretch by 100% to 200%, 120% to 180%, or 140% to 160% in a widthwise direction in an ASTM D3107-07 test of the material, wherein the gauge length is 250 mm, the applied tension is 1.8 kg, and the tension is applied for 30 minutes. In some examples, a material of the portion of the garment 1000 adjacent to the stretch panel may stretch by 4% to 12%, 5% to 11%, or 6% to 10% in a lengthwise direction, and may stretch by 4% to 12%, 5% to 11%, or 6% to 10% in a widthwise direction in an ASTM D3107-07 test of the material, wherein the gauge length is 250 mm, the applied tension is 1.8 kg, and the tension is applied for 30 minutes.

In some examples, stretch percentage can be determined according to the following test. Two marks are made along a lengthwise direction of a rectangular piece of fabric, and the piece of fabric is hung along an upper edge of the piece of fabric so that the two marks are vertically separated relative to the ground. A first measurement of a vertical distance between the two marks is measured while the piece of fabric is hanging along its upper edge and without any weight hanging from a lower edge of the piece of fabric opposite to the upper edge. A set weight (e.g., 3 kg or 5 kg) is then hung along the lower edge of the piece of fabric, and a second measurement of the vertical distance between the two marks is measured after a set amount of time (e.g., 5 s or 10 s) has passed from when the weight is hung along the lower edge. In some examples, before the second measurement is made, the fabric may be subjected to a normalizing process whereby the weight is applied to the lower edge for a set amount of time (e.g., 5 s) and removed, and this process is repeated a set number (e.g., 4 or 5) of times. The stretch percentage is calculated to be 100 times a ratio of (i) the second measurement subtracted by the first measurement to (ii) the first measurement.

The garment 1000 may be a multi-layered garment, and the first to fourth stretch panels 1400, 1500, 1600, and 1700, and the respective adjacent portions of the garment 1000 may refer to an outermost layer of the garment 1000 or a main layer of the garment 1000 (e.g., a layer having a greatest thickness). Other layers in the garment 1000 may include, for example, a membrane layer designed to at least partially block wind and water, and which may be positioned behind the stretch panels and the respective adjacent portions of the garment 1000.

The torso portion 1100 has a front side 1110, which is depicted in FIGS. 4-6, and a back side 1120, which is depicted in FIGS. 1-3. The torso portion 1100 may have an upper or top end 1130, a lower or bottom end 1140, a first side 1150, and a second side 1160. Each of the top end 1130 and the first and second side 1150 and 1160 may define a boundary between the front side 1110 and the back side 1120 of the torso portion 1100, and the bottom end 1140 may define a hem of the garment 1000. The bottom end 1140 may be configured to surround a person's waist when worn, and the top end 1130 may be positioned opposite to the bottom end 1140 and be configured to at least partially cover the person's shoulders when worn. As shown, for example, in FIG. 4, the top end 1130 may define the entire boundary between the front side 1110 and the back side 1120 that is between a neck opening 1190 of the garment 1000 and the right sleeve 1200 and the entire boundary between the front side 1110 and the back side 1120 that is between the neck opening 1190 and the left sleeve 1300. The first and second side 1150 and 1160 may respectively extend between the bottom end 1140 and junctions defined by where the first and second side 1150 and 1160 meet the first and second sleeves 1200 and 1300. The first side 1150 may be referred to as a "right side," and the second side 1160 may be referred to as a "left side."

The first sleeve 1200 and second sleeve 1300 may respectively be attached to the torso portion 1100 at the first sleeve boundary 1170 and the second sleeve boundary 1180. In some examples the first sleeve boundary 1170 and the second sleeve boundary 1180 are boundary lines respectively between the first and second sleeves 1200 and 1300 and the torso portion 1100, and the boundary lines may each be defined by at least one stitching line. The first sleeve boundary 1170 may be referred to as a "right sleeve boundary," and the second sleeve boundary 1180 may be referred to as a "left sleeve boundary."

The first sleeve 1200 may have a proximal end 1210 attached to the torso portion 1100 and a distal end 1220 opposite to the proximal end 1210. The distal end 1220 may correspond to a cuff of the first sleeve 1200, and the proximal end 1210 may correspond to the first sleeve boundary 1170. The first sleeve 1200 may include a first upper arm portion 1230 coupled (e.g., attached) to the torso portion 1100 and a first forearm portion 1240 coupled (e.g., attached) to the first upper arm portion 1230. For example, the first upper arm portion 1230 may extend from the torso portion 1100, and the first forearm portion 1240 may extend from the first upper arm portion 1230. The first upper arm portion 1230 may be configured to cover a person's right upper arm (e.g., the portion of the person's right arm between the person's right shoulder and the person's right elbow), and the first forearm portion 1240 may be configured to cover the person's right forearm (e.g., the portion of the person's right arm between the person's right elbow and the person's right hand). The second sleeve 1300 may have any corresponding features that the first sleeve 1200 may have. For example, the second sleeve 1300 may have a proximal end and a distal end, and may include a second upper arm portion and a second forearm portion.

The first stretch panel 1400 will now be described in more detail according to some examples of the present disclosure. The first stretch panel 1400 may be referred to as the back-right stretch panel 1400 because the first stretch panel 1400 is primarily located on the back side 1120 of the garment 1000 and on the right-hand side 1150. The second stretch panel 1500 (e.g., the back-left stretch panel 1400) may include any corresponding features (e.g., shape, size, position, and orientation) corresponding to the features of the first stretch panel 1400. For example, the second stretch panel 1500 may be symmetrical to the first stretch panel 1400 with respect to a virtual back longitudinal center line 1120C extending along a longitudinal direction, and through a center, of the back side 1120 of the torso portion 1100. In some examples, a coordinate system is defined as being centered at a geometric center of the back side 1120 of the torso portion 1100 when the torso portion 1100 is smoothly spread out over a flat surface with the front side 1110 facing the flat surface and the back side 1120 facing away from the flat surface. A longitudinal axis extends along the back side 1120 of the torso portion 1100 and along a direction parallel to a line extending from a center of the bottom end 1140 to a center of a top end 1130 (which may correspond to a center of a portion of a collar of the garment 1000 that is attached to the torso portion 1100). A lateral axis extends along the back side 1120 and along a direction perpendicular to the longitudinal axis.

The first stretch panel 1400 may have a top edge 1420 proximal to the top end 1130 of the torso portion 1100, a bottom edge 1410 proximal to the bottom end 1140 of the torso portion 1100, a first side edge 1430 proximal to the first sleeve 1200, a second side edge 1430 distal to the first sleeve 1200, and a front edge 1450. The first stretch panel 1400 is positioned at least partially on the back side 1120 of the torso portion 1100 adjacent (e.g., immediately adjacent) to where the first sleeve 1200 is attached to the torso portion 1100. The first stretch panel 1400 may be positioned partially on the back side 1120 of the torso portion 1100 and extend around the first side 1150 of the torso portion 1100 to be positioned partially on the front side 1110 of the torso portion 1100. Thus, the first stretch panel 1400 may include a back-side portion 1401 positioned on the back side 1120 of the torso portion 1100 and an extension portion 1402 positioned on the front side 1110 of the torso portion 1100.

The first stretch panel 1400 may extend from the back side 1120 to the front side 1110 across a portion of the first side 1150 adjacent (e.g., immediately adjacent) to the first sleeve 1200. For example, the first side edge 1430 may at least partially extend along a portion of the first sleeve boundary 1170 that extends from the back side 1120 across the first side 1150 and onto the front side 1110. A portion of the first stretch panel 1400 extending from the back side 1120 to the front side 1110 may at least partially extend across and cover a part of the torso portion 1100 that forms a first armpit portion 1840 together with a part of the first sleeve 1200. The first armpit portion 1840 includes a junction point defined by where the first side 1150 meets the first sleeve 1200 and an adjacent region (e.g., a region within 1 inch, 2 inches, or 3 inches of the junction point in all directions along the garment 1000). The garment 1000 may further include a second armpit portion 1850 on the opposite side of the garment 1000.

The first stretch panel 1400 may be spaced apart from the top end 1130 by a set distance. For example, a minimum distance along the longitudinal direction between the first stretch panel 1400 and the top end 1130 may be 2% to 10% or 4% to 8% of a maximum longitudinal length D11, which is measured from a bottom of the collar of the garment 1000 to a bottommost point of the garment 1000 in the longitudinal direction. For instance, the garment 1000 may include a first shoulder portion 1820 including a portion of the top end 1130 adjacent (e.g., immediately adjacent) to the first sleeve 1200 and extending downward from the portion of the top end 1130 along a portion of each of the front and back sides 1110 and 1120 by a set distance. The first stretch panel 1400 may be adjacent (e.g., immediately adjacent) to the first shoulder portion 1820 without covering the first shoulder portion 1820. The garment 1000 may also include a second shoulder portion 1830 on the opposite side of the garment 1000. In some examples, the top edge 1420 may be a straight line parallel to the top end 1130 and spaced apart from the top end 1130 along a direction perpendicular to the straight line of the top edge 1420 by a distance D45, which may be 2% to 10% or 4% to 8% of the maximum longitudinal length D11.

In some examples, the first stretch panel 1400 is spaced apart from the virtual back longitudinal center line 1120C and from the bottom end 1140. The first stretch panel 1400 and the second stretch panel 1500 may be symmetrically positioned (e.g., mirrored) about the longitudinal center line 1120C. In such examples, the point of the first stretch panel 1400 positioned closest to the longitudinal center line 1120C located a distance from the center line 1120C is the same distance as the center line 1120C to the point of the second stretch panel 1500 positioned closest to the longitudinal center line 1120C.

The top edge 1420 of the first stretch panel 1400 may have a first end 1421 proximal to the first sleeve 1200 (e.g., on the first sleeve boundary 1170) and a second end 1422 distal to the first sleeve 1200. A height D41 (FIG. 2), as defined along the longitudinal direction from the bottom end 1140 to the first end 1421 may be 75% to 95% or 80% to 90% of the maximum longitudinal length D11. A height D43 of the second end 1422 may be 80% to 98% or 86% to 94% of the maximum longitudinal length D11. For instance, the first end 1421 may be higher (e.g., closer to the top end 1130) than the second end 1422.

In some examples, the height D43 is a maximum height of the first stretch panel 1400. In other examples, the height D41 of the first end 1421 or a height of an intermediate region of the top edge 1420 between the first and second ends 1421 and 1422 is the maximum height of the first stretch panel 1400. The height D41 may also be minimum height of the top edge 1420 of the first stretch panel 1400.

The second side edge 1440 of the first stretch panel 1400 has a first end 1441 proximal to the top end 1130 of the garment 1000. The second side edge 1440 also has a second end 1442 distal to the top end 1130 (e.g., located closer to the bottom end 1140). An intermediate region 1443 of the second side edge 1440 exists between the first end 1441 and the second end 1442 that is a closest region of the second side edge 1440 to the second stretch panel 1500.

In some examples, the first end 1441 of the second side edge 1440 coincides with the second end 1422 of the top edge 1420 (e.g., at an upper, interior corner of the first stretch panel 1400). A lateral distance D50 (FIG. 3) between the first end 1441 and the first sleeve 1200 (e.g., the first sleeve boundary 1170) may be 15% to 35% or 20% to 30% of a maximum lateral width D12 between the first and second sides 1150 and 1160. A lateral distance D51 between the first end 1441 and the second stretch panel 1500 may be 30% to 50% or 35% to 45% of the maximum lateral width D12.

In some examples, a height D44 (FIG. 2) of the interior-most point of the intermediate region 1443 (e.g., the point of the first stretch panel 1400 closest to the longitudinal center line 1120C) is 60% to 80% or 65% to 75% of the maximum longitudinal length D11. A lateral distance D48 (FIG. 3) between the intermediate region 1443 and the first sleeve 1200 may be 15% to 35% or 20% to 30% of the maximum lateral width D12. A lateral distance D49 between the interior-most point of the intermediate region 1443 and the interior-most point of the second stretch panel 1500 may be 10% to 30% or 15% to 25% of the maximum lateral width D12. In some examples, the lateral distance D49 is a minimum distance between the first and second stretch panels 1400 and 1500. In some other examples, the first and second stretch panels 1400 and 1500 may be closest to each other at the first end 1441 or at the second end 1442 of the second side edge 1440.

A height D42 (FIG. 2) of a bottom edge 1410 of the second end 1442 of the first stretch panel 1400 above the bottom end 1140 may be 25% to 45% or 30% to 40% of the maximum longitudinal length D11. In some examples, the height D42 is a minimum distance between the first stretch panel 1400 and the bottom end 1140. A lateral distance D46 (FIG. 3) between the second end 1442 and the first side 1150 (or, in some other examples, the first sleeve 1200) may be 10% to 30% or 15% to 25% of the maximum lateral width D12. A lateral distance D47 between the second end 1442 and the second stretch panel 1500 may be 50% to 70% or 55% to 65% of the maximum lateral width D12. In some examples, the lateral distance D47 is, at least on the back side 1120, a maximum distance between interior edges of the first and second stretch panels 1400 and 1500.

The bottom edge 1410 of the first stretch panel 1400 may have a first end 1411, a second end 1412, and an intermediate region 1413 between the first and second ends 1411 and 1412. In some examples, the first end 1411 is on the back side 1120, the second end 1412 is on the front side 1110, and the intermediate region 1413 wraps around the first side 1150 between the front and back sides 1110 and 1120. The first end 1411 of the bottom edge 1410 may coincide with the second end 1442 of the second side edge 1440 (e.g., at a lower-interior corner of the of the first stretch panel 1400). A height D54 (FIG. 5) of the second end 1412 may be 40% to 60% or 45% to 55% of the maximum longitudinal length D11. A lateral distance D55 (FIG. 5) between the first side 1150 and the second end 1412 may be 5% to 25% or 10% to 20% of the maximum lateral width D12. A height D52 of the midpoint of the intermediate region 1413 may be 35% to 55% or 40% to 50% of the maximum longitudinal length D11. In some examples, the height D52 of the intermediate region 1413 is greater than the height D42 of the first end 1411 and is less than the height D54 of the second end 1412. In some other examples, the first stretch panel 1400 is closest to the bottom end 1140 at the first end 1411, the second end 1412, or the intermediate region 1413.

The front edge 1450 of the first stretch panel 1400, which connects the bottom edge 1410 and the first side edge 1430, has a first end 1451 and a second end 1452. In some examples, the first end 1451 of the front edge 1450 coincides with the second end 1412 of the bottom edge 1410. The second end 1452 may be on the first sleeve boundary 1170. A height D53 (FIG. 5) of the second end 1452 may be 45% to 65% or 50% to 60% of the maximum longitudinal length D11.

The first side edge 1430 of the first stretch panel 1400 has a first end 1431 proximal to the top end 1130 and a second end 1432 distal to the top end 1130. In some examples, the first end 1431 of the first side edge 1430 coincides with the second end 1452 of the front edge 1450 (e.g., at an upper-front corner). In some other examples, the front edge 1450 is omitted, and the first end 1431 of the first side edge 1430 coincides with the second end 1412 of the bottom edge 1410. In some examples, the second end 1432 of the first side edge 1430 coincides with the first end 1421 of the top edge 1420 (e.g., at an upper, arm-side corner of the first stretch panel 1400).

The top edge 1420 and the bottom edge 1410 may be straight lines, each having a length of 10% to 40% or 15% to 35% of the maximum lateral width D12. In some examples, the top edge 1420 and the bottom edge 1410 may be the same or different in length. For example, the bottom edge 1410 may be greater than the top edge 1420 in length. The top edge 1420 and the bottom edge 1410 may be parallel or non-parallel to each other. For example, virtual lines tangent to the top edge 1420 and the bottom edge 1410 may cross each other in a back plan view at a crossing region spaced apart from the first stretch panel 1400. For example, the crossing region may be spaced apart to the right of the first stretch panel 1400 such that the first stretch panel 1400 is between the crossing region and the second sleeve 1300 in the back plan view.

In some examples, the first side edge 1430 and the second side edge 1440 are arced lines convex to the virtual back longitudinal center line 1120C. The first side edge 1430 and the second side edge 1440 may have a variable radius of curvature, and each of the first and second side edges 1430 and 1440 may have a minimum radius of curvature of 20% to 40% or 25% to 35% of the maximum lateral width D12. The minimum radius of curvature of the second side edge 1440 may be in the intermediate region 1443 and may occur at the interior-most point of the intermediate region 1443. For instance, the minimum radius of curvature may occur at a height that is greater than 50% of the maximum longitudinal length D11. In some examples, each of the first and second side edges 1430 and 1440 may have an average radius of curvature of 30% to 100% of the maximum lateral width D12. An average distance between the first and second side edges 1430 and 1440 may be 10% to 40% or 15% to 35% of the maximum lateral width D12.

The garment 1000 may also include a stretch panel on each of the sleeves. The left sleeve 1300 may include a left-sleeve stretch panel 1700, and the right sleeve 1200 may include a right-sleeve stretch panel 1600. The right-sleeve stretch panel 1600 may be referred to as the third stretch panel 1600, and the left-sleeve stretch panel 1700 may be referred to as the fourth stretch panel 1700. The third stretch panel 1600 will now be described in more detail according to some examples of the present disclosure, and the fourth stretch panel 1700 may include any corresponding features (e.g., shape, size, position, and orientation) that the third stretch panel 1600 may have but for inclusion on the left sleeve 1300. For instance, in some examples, the left-sleeve stretch panel 1700 is symmetric or a mirror image of the right-sleeve stretch panel 1600.

The third stretch panel 1600 is positioned at least partially on the first forearm portion 1240 of the first sleeve 1200. The third stretch panel 1600 may be shaped and sized to extend circumferentially at least partially around the first sleeve 1200. In some examples, the third stretch panel 1600 is positioned entirely on the first forearm portion 1240. For instance, no portion of the third stretch panel 1600 extends past the elbow and onto first upper arm portion 1230. In some other examples, the third stretch panel 1600 extends partially onto the first upper arm portion 1230. The third stretch panel 1600 may extend circumferentially around the entire first sleeve 1200. For example, the third stretch panel 1600 may have a closed-ribbon shape surrounding the first sleeve 1200.

The third stretch panel 1600 has a first edge 1610 proximal to the torso portion 1100 and a second edge 1620 distal to the torso portion 1100. Each of the first and second edges 1610 and 1620 extend circumferentially at least partially around the first sleeve 1200 and may be positioned at least partially on the first forearm portion 1240. In some examples, the first and second edges 1610 and 1620 are both positioned entirely on the first forearm portion 1240. In some other examples, the second edge 1620 is positioned entirely on the first forearm portion 1240, and the first edge 1610 is positioned partially on the first forearm portion 1240 and partially on the first upper arm portion 1230.

The third stretch panel 1600 may extend both (e.g., simultaneously) circumferentially around the first sleeve 1200 and along a longitudinal direction of the first sleeve 1200. The longitudinal direction of the first sleeve 1200 may be defined as a direction extending between the proximal and distal ends 1210 and 1220 of the first sleeve 1200. Accordingly, the first and second edges 1610 and 1620 of the third stretch panel 1600 may also extend both (e.g., simultaneously) circumferentially around the first sleeve 1200 and along the longitudinal direction of the first sleeve 1200. As an example, as the third stretch panel 1600 wraps around the first sleeve 1200, the third stretch panel 1600 moves towards and/or away from the torso portion 1100. For instance, the portion of the third stretch panel 1600 on the underside of the first sleeve 1200 is positioned closest to the torso portion 1100, and the portion of the third stretch panel 1600 on the upper side of the first sleeve 1200 is positioned furthest from the torso portion 1100 (e.g., closest to the cuff). In such examples, the first edge 1610 and the second edge 1620 may have a substantially "S" shape.

The first sleeve 1200 has a top line 1250 extending from the distal end 1220 (e.g., the cuff) of the first sleeve 1200 to the top end 1130 of the torso portion 1100. The first sleeve 1200 also has a bottom line 1260 extending from the distal end 1220 of the first sleeve 1200 to the armpit portion 1840. The top and bottom lines 1250 and 1260 may be defined such that they substantially do not extend circumferentially around the first sleeve 1200. In some examples, the third stretch panel 1600 covers one or both of a portion of the top line 1250 and a portion of the bottom line 1260.

A length L1250 (FIG. 6) of the top line 1250 of the first sleeve 1200 may be the sum of a distance D61 along the top line 1250 between the distal end 1220 of the first sleeve 1200 and the second edge 1620 of the third stretch panel 1600, a distance D62 along the top line 1250 between the second edge 1620 and the first edge 1610 of the third stretch panel 1600, and a distance D63 along the top line 1250 between the first edge 1610 of the third stretch panel 1600 and the proximal end 1210 of the first sleeve 1200. The distance D61 may be 3% to 23% or 8% to 15% of the length L1250, the distance D62 may be 10% to 30% or 15% to 25% of the length L1250, and the distance D63 may be 60% to 80% or 65% to 75% of the length L1250.

A length L1260 of the bottom line 1260 may be the sum of a distance D64 along the bottom line 1260 between the distal end 1220 of the first sleeve 1200 and the second edge 1620 of the third stretch panel 1600, a distance D65 along the bottom line 1260 between the second edge 1620 and the first edge 1610 of the third stretch panel 1600, and a distance D66 along the bottom line 1260 between the first edge 1610 of the third stretch panel 1600 and the proximal end 1210 of the first sleeve 1200. The distance D64 may be 25% to 45% or 30% to 40% of the length L1260, the distance D65 may be 20% to 40% or 25% to 35% of the length L1260, and the distance D66 may be 20% to 40% or 25% to 35% of the length L1260.

In some examples, each of the first and second edges 1610 and 1620 may be closest to the proximal end 1210 at the bottom line 1260 and may be furthest from the proximal end 1210 at the top line 1250. For example, the distance D66 may be smaller than the distance D63, and the sum of the distances D65 and D66 may be smaller than the sum of the distances D62 and D63. The sum of the distances D61 and D62 may be smaller than the sum of the distances D64 and D65, and the distance D61 may be smaller than the distance D64.

An average distance between the first and second ends 1610 and 1620 along the longitudinal direction of the first sleeve 1200 may be 10% to 30% or 15% to 25% of the length L1250, or 20% to 40% or 25% to 35% of the length L1260. In some examples, the lengths L1250 and 1260 are respectively maximum and minimum lengths of the first sleeve 1200 along the longitudinal direction of the sleeve. In some examples, the distance between the first and second ends 1610 and 1620 along the longitudinal direction of the first sleeve 1200 may be constant. In some other examples, the distance between the first and second ends 1610 and 1620 along the longitudinal direction of the first sleeve 1200 may vary along a circumferential direction. For example, the distance D65 may be greater than the distance D62.

The non-stretching portions (e.g., woven material portions) of the garment 1000 may be referred to as a non-stretch panels. For instance, for the garment 1000 depicted, the back side 1120 of the torso portion 1100 includes a central non-stretch panel 1901 at least partially between the first stretch panel 1400 and the second stretch panel 1500. The central non-stretch panel 1901 covers the central part of the back side 1120 and may be substantially hourglass shaped. In the example depicted, the central non-stretch panel 1901 also extends partially to the front side 1110 of the torso portion 1100. The first stretch panel 1400 and the second stretch panel 1500 may be joined (e.g., stitched) to the central non-stretch panel 1901. For example, the first stretch panel 1400 may be joined to the central non-stretch panel 1901 along its second side edge 1440. Two shoulder non-stretch panels 1902 and 1903 may also be provided (e.g., one shoulder non-stretch panel for each side of garment). The shoulder non-stretch panels 1902 and 1903 may be incorporated to provide additional rain protection for the garment. The first stretch panel 1400 may be joined (e.g., along the top edge 1420 of the first stretch panel 1400) to one shoulder non-stretch panel 1902, and the second stretch panel 1500 may be joined to the other shoulder non-stretch panel 1903. Two lower-back non-stretch panels 1904 and 1905 may also be incorporated that are positioned below the first stretch panel 1400 and the second stretch panel 1500, respectively. The two lower-back non-stretch panels are also positioned outside (e.g., away from the center) of the central non-stretch panel 1901. The two lower-back non-stretch panels 1904 and 1905 may extend around the front side 1110 of the torso portion 1100 as well. For instance, each lower-back non-stretch panel 1904 and 1905 may extend from the central non-stretch panel 1901 to a zipper on the front side 1110 of the torso portion 1100. In some examples, the first stretch panel 1400 is joined to one of the lower-back non-stretch panel 1904 along the bottom edge 1410 of the first stretch panel 1400.

The front side 1110 of the torso portion 1100 may also include a right-chest non-stretch panel 1906 and a left-chest non-stretch panel 1907 that are positioned on the respective sides of the chest portion of the front side 1110. As an example, the right-chest non-stretch panel 1906 may be joined (e.g., stitched) to the first stretch panel 1400, the right shoulder panel 1902, the central non-stretch panel 1901, a lower-back non-stretch panel 1904, the zipper, the collar, and the right sleeve 1200.

In some examples, the garment 1000 includes two upper-arm non-stretch panels 1908 and 1909 respectively positioned on the right and left sleeves 1200 and 1300. The upper-arm non-stretch panel 1908 positioned on the right sleeve 1200 may be positioned at least partially on the upper arm portion 1230 of the right sleeve 1200. The upper-arm non-stretch panel 1908 and may be joined (e.g., stitched) to the torso portion 1100 along the first sleeve boundary 1700 and joined (e.g., stitched) to the third stretch panel 1600, for example, along the first edge 1610 of the third stretch panel 1600. The garment 1000 may include two forearm non-stretch panels 1910 and 1911 respectively positioned on the right and left sleeves 1200 and 1300. The forearm non-stretch panel 1910 positioned on the right sleeve 1200 may be positioned at least partially on the forearm portion 1240 of the right sleeve 1200. The forearm non-stretch panel 1910 may be joined (e.g., stitched) to the third stretch panel 1600, for example, the second edge 1620 of the third stretch panel 1600.

The positioning of the stretch panels 1400, 1500, 1600, and 1700 have been described herein based on experimental tests on upper garments, which revealed unexpected data regarding which regions of upper garments are subjected to high levels of tension during a golf swing. By incorporating stretch panels into an upper garment at positions coinciding with these high-tension regions, the upper garment's constraint on the golfer's movements during a golf swing can be reduced, and thus, the golfer's performance can be improved. For example, based on the tension analysis, which is discussed further below, the stretch panels are able to be configured such that areas of high tension during a golf swing may be directly targeted. By directly targeting the high-tension areas, the remainder of the upper garment may be constructed from a substantially waterproof or water-resistant material, which results in a garment that not only provides less resistance to a golf swing but also provides weather-resistant properties as well. Although some examples of garments have been described with reference to FIGS. 1-6, the present disclosure is not limited thereto. For example, the number of stretch panels and the shape, size, position, and orientation of each of the stretch panels may be suitably varied.

Figure 8:
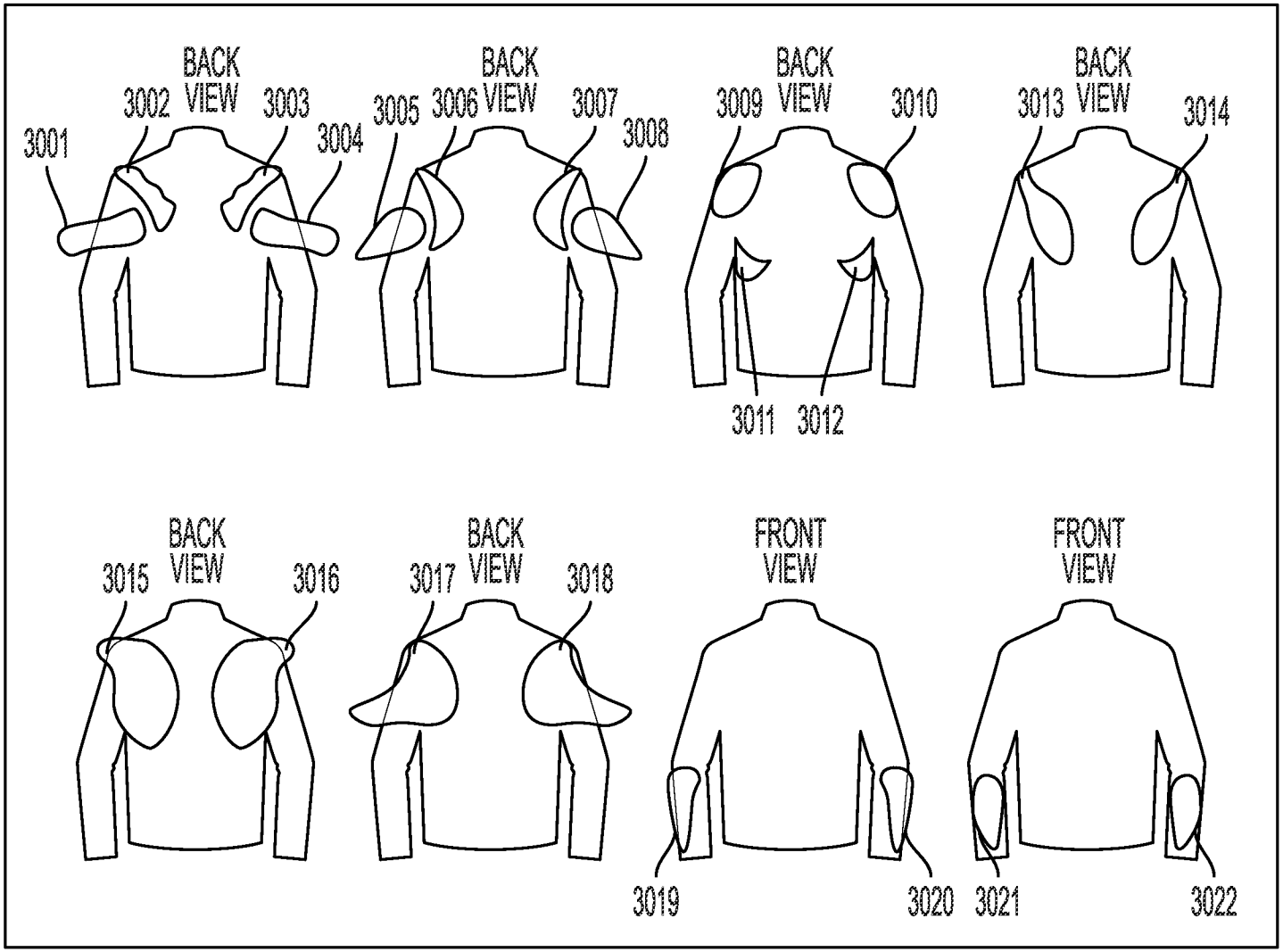
FIG. 8 depicts front and back views of regions of a garment subjected to tension when a player performs a golf swing while wearing the garment.

FIGS. 7A to 7I depict perspective views of stretched regions of a garment being worn by a player at various times while the player performs golf swings, and FIG. 8 depicts front and back views of regions of a garment subjected to tension when a player performs a golf swing while wearing the garment. In particular, stretched regions 2001-2012 identified during testing are depicted in FIGS. 7A to 7I. The testing included acquiring imaging of a golfer during a golf swing while wearing a stretchable garment. The imaging techniques utilized allowed for areas of high tension or high stretching to be visually identified in the resultant images. Those areas of high tension have been identified as stretched regions 2001-2012 in the Images reproduced in FIGS. 7A-7I. In FIG. 7A, a front view of a right-handed golfer during his backswing is depicted. During the backswing, a first stretched region 2001 that extends over the shoulder of the golfer was identified as well as a second stretched region 2002 that extends across the back of the golfer in a direction from the top of the golfer towards the waist of the golfer. FIG. 7B depicts a front view of the golfer during a follow through of the golf swing. During the follow through, a third stretched region 2003 on the golfer's back was identified along with a fourth stretched region 2004 that is primarily located on the shoulder of the golfer. FIG. 7C depicts a left-side view of the golfer (e.g., from the perspective of the golf target) at or near impact of the golf ball. At this position, a fifth stretched region 2005 was identified under the shoulder and near the armpit of the golfer. FIG. 7D depicts a front view at the end of the follow through of the golf swing. At this position, a sixth stretched region 2006 that extended from the shoulder and down the back of the golfer was identified. FIG. 7E depicts another front view of the golfer during a backswing of the golfer. FIG. 7E further captures the left arm of the golfer. During the backswing, a seventh stretched region 2007 along the forearm of the golfer was identified. An eighth stretched region 2008 on the shoulder was also identified. The eighth stretched region 2008 is consistent with the first stretched region 2001 of the shoulder identified in FIG. 7A. FIG. 7F depicts a left-side (e.g., target-side) view of the golfer during a backswing. During the backswing, a ninth stretched region 2009 was identified that encompassed a larger portion of the golfer's upper back and shoulder. FIG. 7G depicts a right-side view of the golfer during a backswing. A tenth stretched region 2010 was identified in FIG. 7G along the forearm of the golfer. FIG. 7H depicts another front view of the golfer during a follow through. An eleventh stretched region 2011 was identified along the golfer's back and shoulder. FIG. 7I is a front view of the golfer during a follow through. FIG. 7I focuses on the golfer's arms, and a twelfth stretched region 2012 was identified on the forearm of the golfer.

Based on the identified stretched regions 2001-2012 identified across the images of FIGS. 7A to 7I, the stretch panels of the present technology discussed above in FIGS. 1-6 were developed. For instance, the stretch panels were developed to capture and substantially match portions of the stretched regions 2001-2012 to specifically target areas of high tension that occur during the golf swing. To still provide for weather resistance properties of the garment, however, the size and position of the stretch panels were not developed to identically match the stretched regions 2001-2012. Instead, the stretch panels were developed to encompass a majority of the stretched regions 2001-2012 to reduce the resistance the garment produces to the golf swing while still accounting for feasible construction of the garment among other considerations. For instance, in the example garment 1000 discussed above, the shoulder panels of the garment may be constructed from a water-resistant material rather than a stretchable material despite the shoulder of the golfer being identified as a high-tension area of the golfer. Because the shoulders of the golfer are directly exposed to rain falling from the sky, the shoulders are a high-exposure area for rain-related moisture. As such, the extra weather resistance at the shoulders may be desired over additional flexibility where the garment is intended to be a weather-resistant garment, such as a rain jacket.

FIG. 8 depicts additional views or representations of stretched regions 3001-3022 that may be adapted into stretch panels of a garment. For instance, the regions 3001-3022 that may be subjected to tension when being worn by a person swinging a golf club. A garment according to examples of the present disclosure may include a stretch panel encompassing any portion of one or more of the stretched regions 2001-2012 and the regions 3001-3022 when the perspective views of FIGS. 7A to 7I and the front and back views of FIG. 8 are to-scale as depicted. For example, a garment may include a stretch panel that extents over the shoulder and down the back in a direction towards the waist and the center of the back, similar to the region 3002, region 3011, region 3013, and region 3015. A garment may also include a stretch panel wrapped around the upper arm of the sleeve, similar to region 3001 and region 3005. A garment may also include a stretch panel that extends across a back and a sleeve of a garment, similar to region 3015. Such a stretch panel may substantially wrap around the sleeve of the garment as well.

Figure 9:
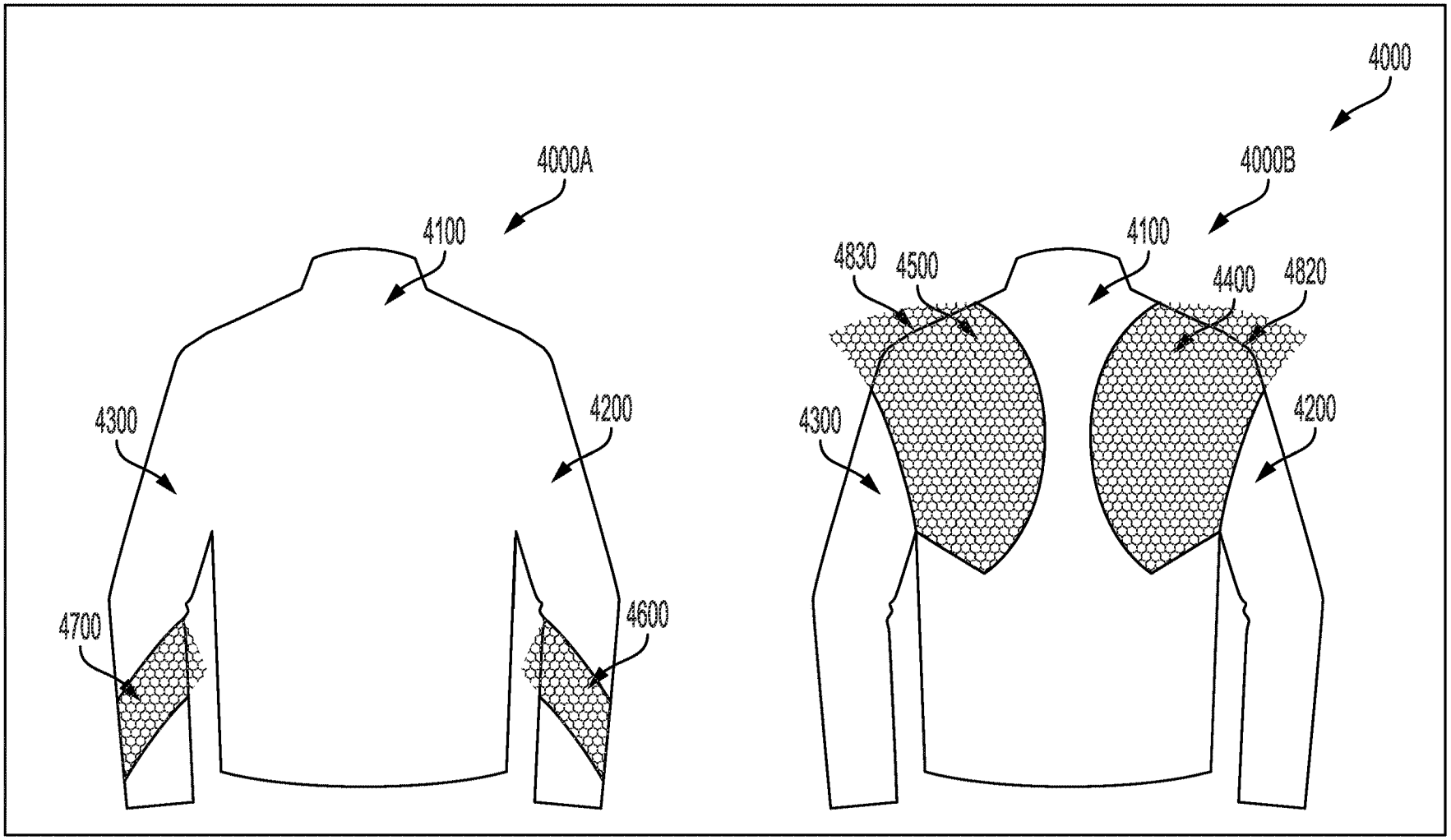
FIG. 9 depicts two partially exploded back views of another example garment, each of the two partially exploded back views illustrating some of the stretch panels of the example garment.
Figure 10:
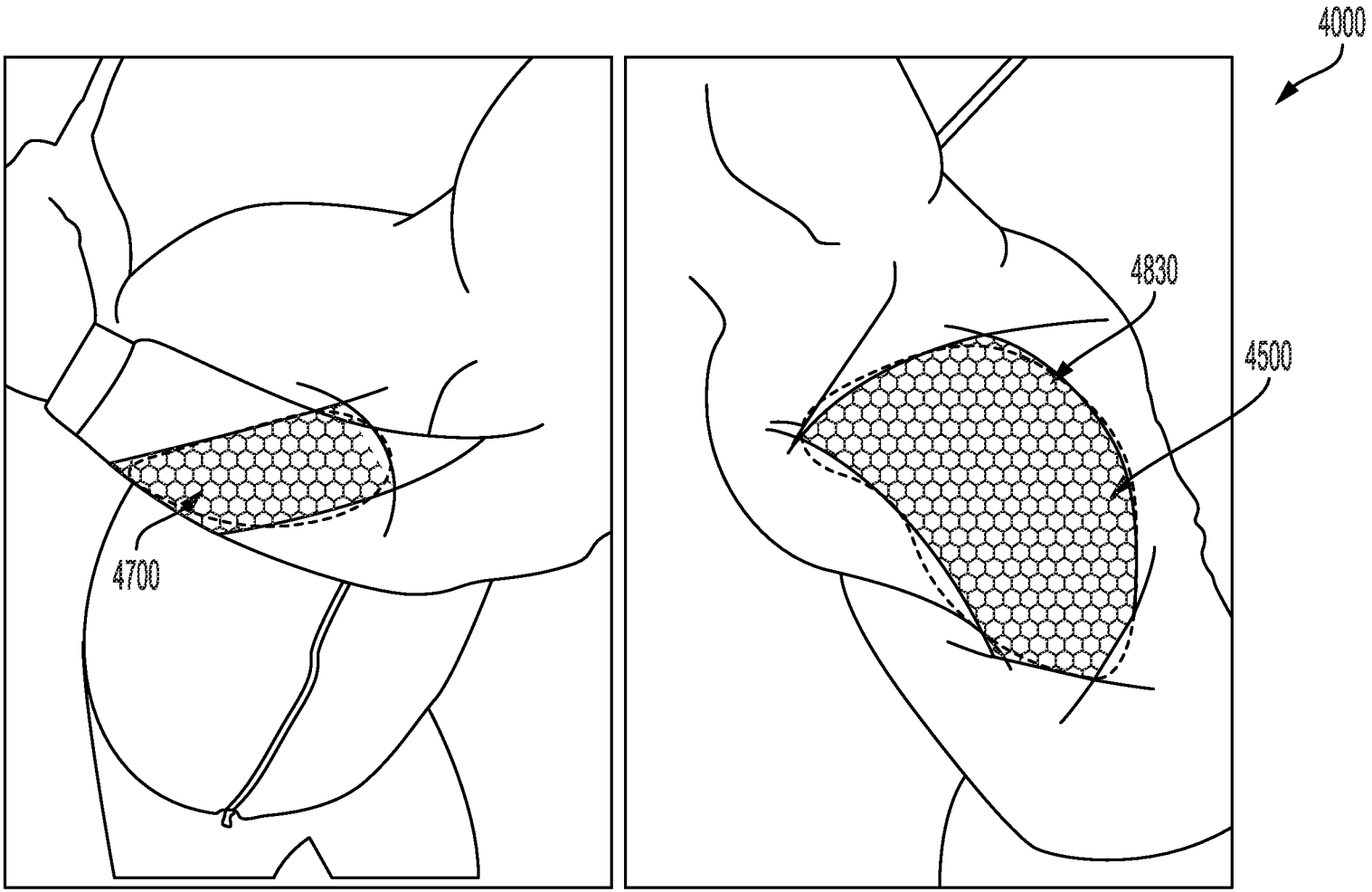
FIG. 10 depicts two perspective views of a golfer performing golf swings while wearing the example garment of FIG. 9.

FIG. 9 depicts two partially exploded back views 4000A and 4000B of another example garment 4000, each of the two partially exploded back views 4000A and 4000B illustrating some of the stretch panels of the example garment 4000. FIG. 10 depicts two perspective views of a golfer performing golf swings while wearing the example garment 4000 of FIG. 9. The garment 4000 primarily differs from the garment 1000 discussed above in that the stretch panels on the back of the garment extend over the shoulder portions of the garment 4000.

The garment 4000 includes a torso portion 4100, first and second sleeves 4200 and 4300 respectively attached to the torso portion 4100, first and second shoulder portions 4820 and 4830, and first, second, third, and fourth stretch panels 4400, 4500, 4600, and 4700 incorporated into the garment 4000. The garment 4000 and the first to fourth stretch panels 4400, 4500, 4600, and 4700 may include some features of garments and stretch panels described herein, and thus, differences will may be mainly described and redundant descriptions may not be repeated.

The first and second stretch panels 4400 and 4500 are positioned at least partially on a back side of the torso portion 4100 and respectively adjacent to the first and second sleeves 4200 and 4300. The first and second stretch panels 4400 and 4500 respectively cover at least part (e.g., all) of the first and second shoulder portions 4820 and 4830, and thus, may extend across a top end of the torso portion 4100 and onto a front side of the torso portion 4100. As indicated in the perspective views of FIG. 7 and the front and back views of FIG. 8, the garment 4000 may be subject to tension in regions corresponding to the first and second shoulder portions 4820 and 4830. Accordingly, by positioning the first and second stretch panels 4400 and 4500 respectively to at least partially cover the first and second shoulder portions 4820 and 4830, constraint of the golfer's movements during a golf swing by the garment 4000 may be further reduced compared to when the first and second stretch panels 4400 and 4500 do not cover the first and second shoulder portions 4820 and 4830. However, because the first and second stretch panels 4400 and 4500 may be made from knit fabric, which is more susceptible to water penetration than other materials (e.g., woven fabric) that may cover the first and second shoulder portions 4820 and 4830 when the first and second stretch panels 4400 and 4500 do not cover the first and second shoulder portions 4820 and 4830, water may more easily penetrate into the inside of the garment 4000 through the first and second shoulder portions 4820 and 4830 during rain.

Figure 11:
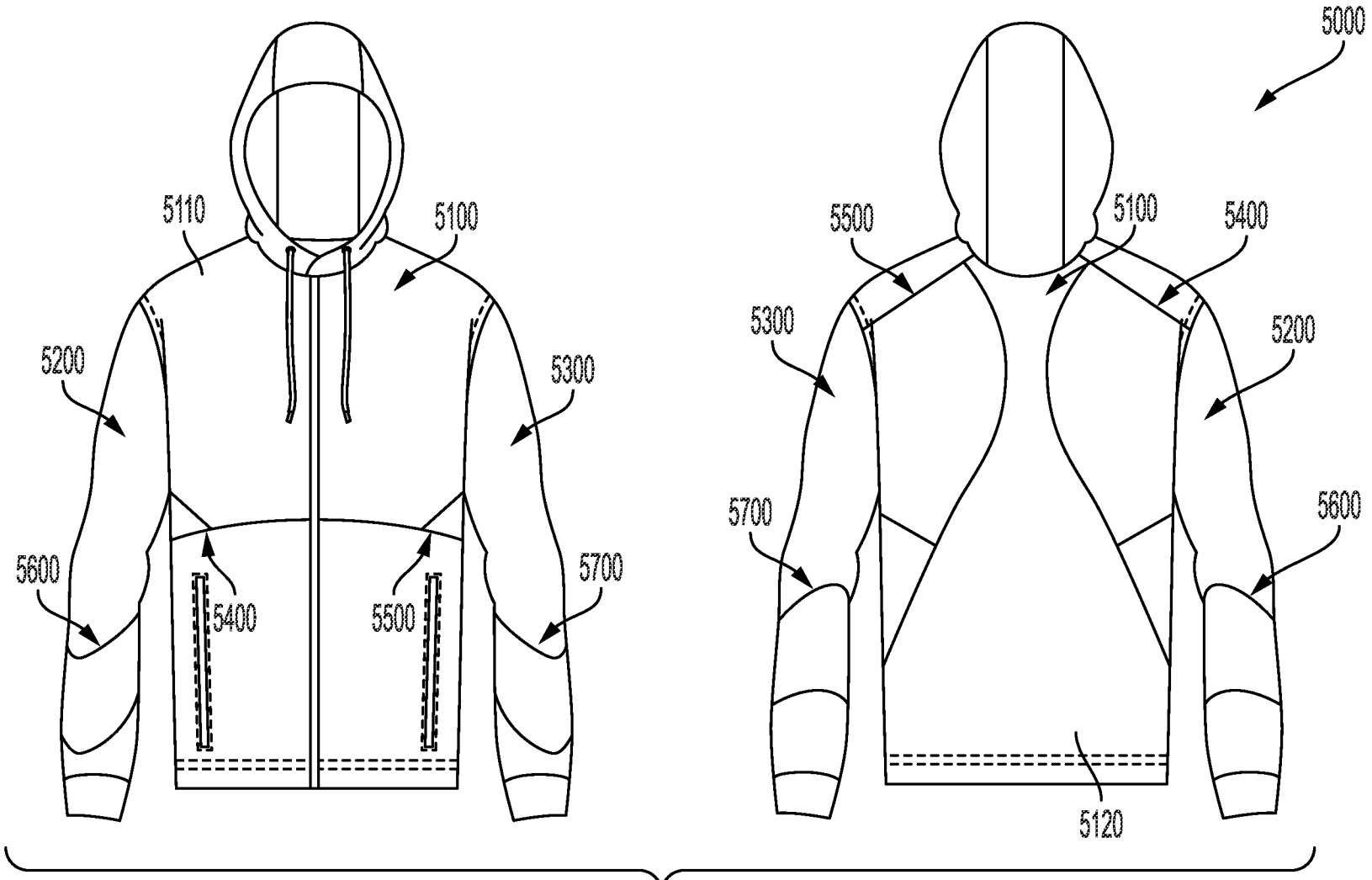
FIG. 11 depicts a front and back view of another example garment.

FIG. 11 depicts a front and back view of another example garment 5000. The garment 5000 includes a torso portion 5100 having a front side 5110 and a back side 5120, first and second sleeves 5200 and 5300 attached to the torso portion 5100, and first, second, third, and fourth stretch panels 5400, 5500, 5600, and 5700 that are incorporated into the garment 5000. The garment 5000 is illustrated as a hooded sweatshirt. The garment 5000 and the first to fourth stretch panels 5400 to 5700 may include any features of garments and stretch panels as described herein.

Figure 12:
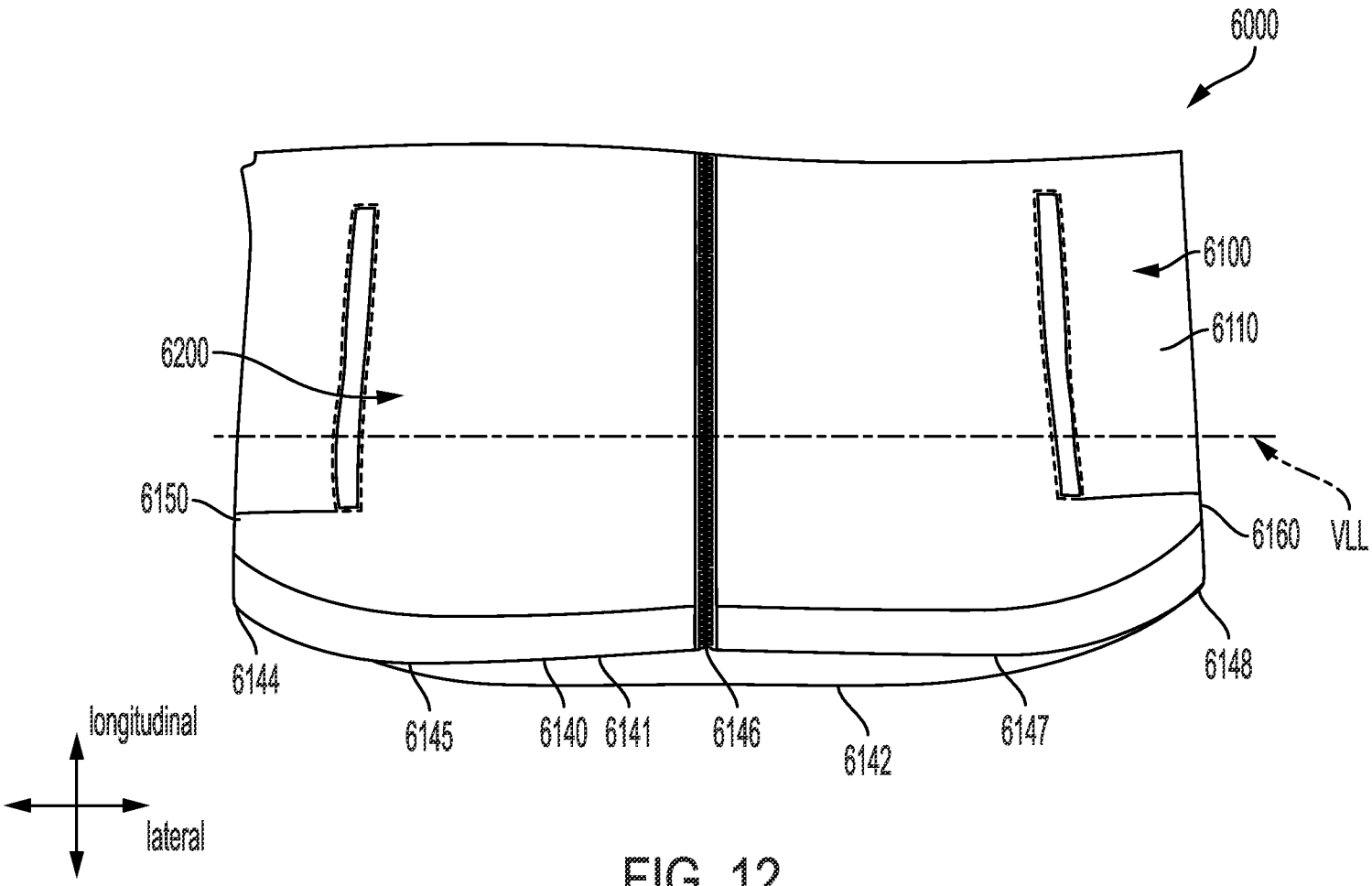
FIG. 12 depicts a partial front view of another example garment.
Figure 13:
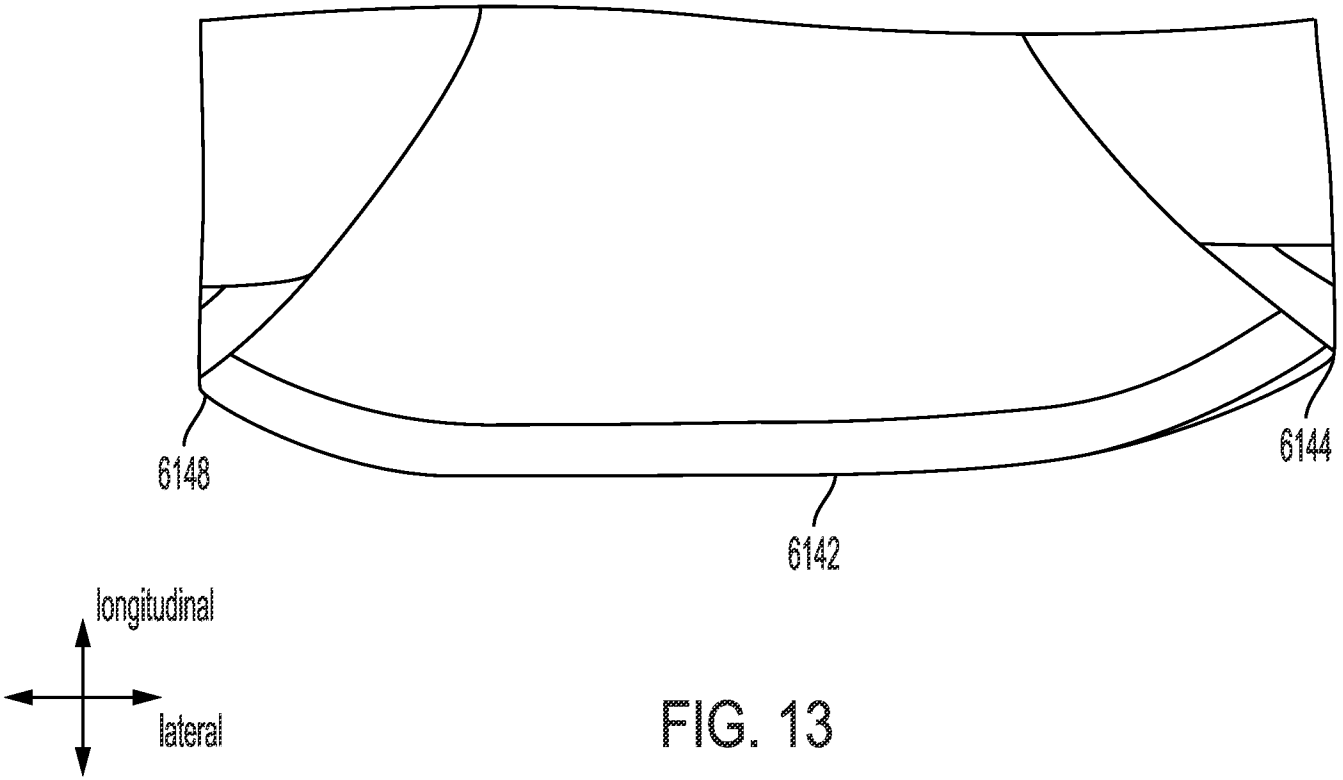
FIG. 13 depicts a partial back view of the garment of FIG. 12.
Figure 14:
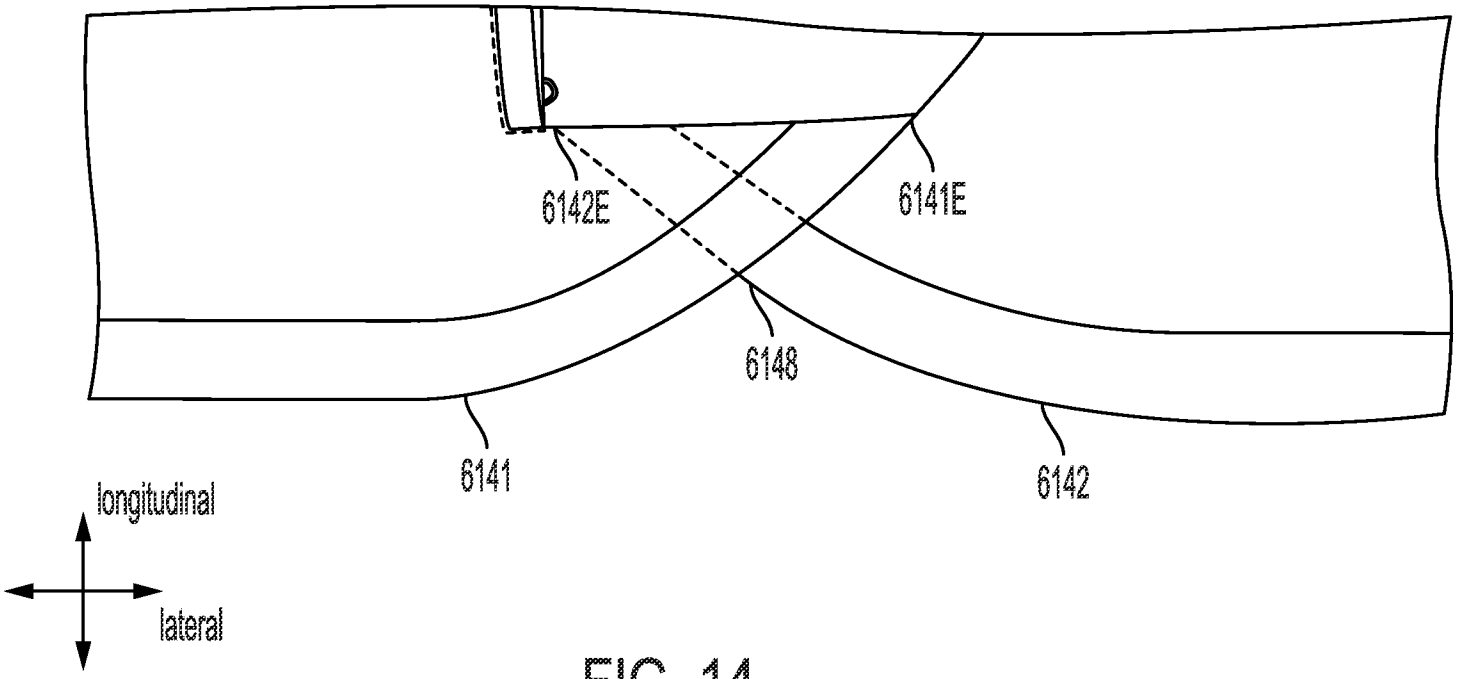
FIG. 14 depicts a partial side view of the garment of FIG. 12.
Figure 15B:
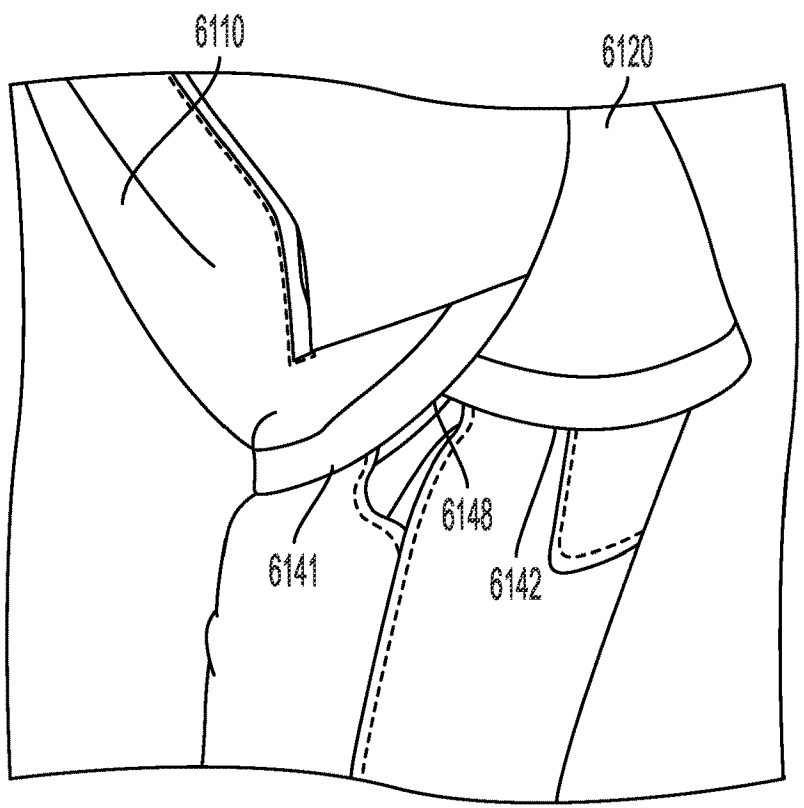
FIG. 15B depicts partial side view of the garment of FIG. 12 being worn by a person when bending forward.
Figure 15A:
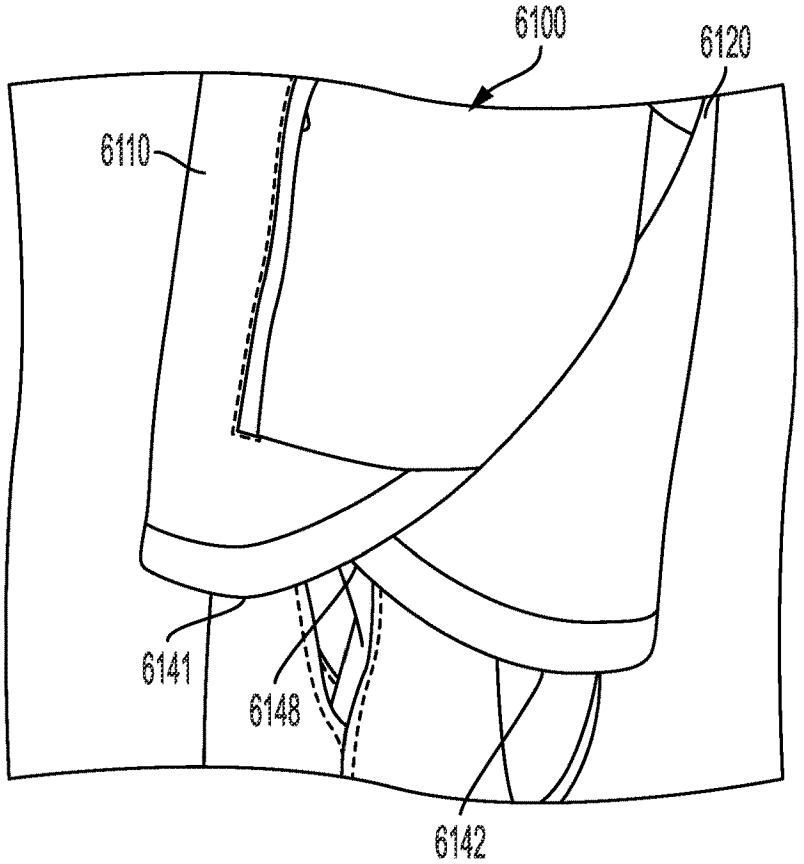
FIG. 15A depicts a partial side view of the garment of FIG. 12 being worn by a person when standing upright.

FIG. 12 depicts a partial front view of another example garment 6000. FIG. 13 depicts a partial back view of the garment 6000 of FIG. 12. FIG. 14 depicts a partial side view of the garment 6000 of FIG. 12. FIG. 15A depicts a partial side view of the garment 6000 of FIG. 12 being worn by a person when standing upright. FIG. 15B depicts a partial side view of the garment 6000 of FIG. 12 being worn by a person when bending forward. The garment 6000 includes a torso portion 6100, a first sleeve attached to the torso portion 6100, and a second sleeve attached to the torso portion 6100. The torso portion 6100 has a front side 6110, a back side 6120, a top end, a bottom end 6140 opposite to the top end, a first side 6150, and a second side 6160. In some examples, the garment 6000 may further include stretch panels incorporated into the garment 6000. In some other examples, the garment 6000 does not include stretch panels. The garment 6000 and the stretch panels of the garment 6000 may include any features of garments and stretch panels as described herein.

The bottom end 6140 may form a hem of the garment 6000 having a unique shape and design configured to move with a person wearing the garment 6000 as he or she bends forward, for example, to take a golf swing. This reduces the amount by which the front side 6110 of the torso portion 6100 (e.g., by which a zipper on the front side 6110) bulges forward when the person bends forward. As shown in FIGS. 15A and 15B, the hem of the garment 6000 moves with the person wearing the garment 6000 when bending forward from an upright position (as shown in FIG. 15A) to a bent forward position (as shown in FIG. 15B) such that the front side 6110 of the torso portion 6100 does not substantially bulge forward when the person is in the bent forward position. The bulging of a garment may obstruct the golfer's movements when taking a golf swing, and thus, reducing this bulging will reduce the garment's negative impact on the golfer's swing and improve the golfer's performance.

The bottom end 6140 has a front portion 6141 corresponding to at least part of the front side of the torso portion 6100 and a back portion 6142 corresponding to at least part of the back side of the torso portion 6100. The front portion 6141 may have a W-shape. For example, the front portion 6141 may have a first periphery region 6144, a second periphery region 6148, a middle region 6146 (e.g., a region corresponding to an end of a zipper) between the first periphery region 6144 and the second periphery region 6148, a first intermediate region 6145 between the first periphery region 6144 and the middle region 6146, and a second intermediate region 6147 between the second periphery region 6148 and the middle region 6146. In some examples, the first periphery region 6144 is at (e.g., defines a bottom end of) the first side 6150, and the second periphery region 6148 is at (e.g., defines a bottom end of) the second side 6160.

Relative to a virtual lateral line VLL extending across the front side 6110 of the torso portion 6100 and positioned between the bottom end 6140 of the torso portion 6100 and the top end of the torso portion 6100, the first intermediate region 6145 may extend farther downward along a longitudinal direction than each of the first end 6144 and the middle region 6146, and the second intermediate region 6147 may extend farther downward along the longitudinal direction than each of the second end 6148 and the middle region 6146. In some examples, the middle region 6146 extends farther downward along the longitudinal direction than each of the first end 6144 and the second end 6148. In some other examples, each of the first end 6144 and the second end 6148 extend farther downward along the longitudinal direction than the middle region 6146. The back portion 6142 may extend downward along the longitudinal direction as the back portion 6142 respectively extends away from the first and second periphery regions 6144 and 6148.

The front and back portions 6141 and 6142 of the bottom end 6140 may cross each other at the first and second periphery regions 6144 and 6148. At each of the first and second periphery regions 6144 and 6148, the front portion 6141 may further extend at least partially onto the back side 6120 to an end 6141E, and the back portion 6142 may further extend at least partially onto the front side 6110 to an end 6142E. The front and back portions 6141 and 6142 may overlap with, and be disconnected (e.g., not stitched together) from, each other at each of the first and second periphery regions 6144 and 6148.

In some examples, the hem of the garment 6000 is stiffer than adjacent portions of the garment 6000. For example, the hem may be different in material than the adjacent portions of the torso portion 6100, or the hem may be the same in material as the adjacent portions of the torso portion 6100 and the material at the hem may be folded over on itself one or more times, rolled, or arranged in another manner that increases the stiffness of the hem. In some examples, the hem may include a strip of relatively stiff material compared to the adjacent portions of the torso portion and that extends along the bottom end 6140. The strip may include plastic, metal, etc.

Garments according to some examples of the present disclosure may include a hem having any features described herein and one or more stretch panels having any features described herein. Using the stretch panels and the hem in combination further reduces negative impacts of the garment on the movements of a golfer wearing the garment while taking a golf swing and improves the golfer's performance.

This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art. Further, one having skill in the art will understand the degree to which terms such as "about" or "substantially" convey in light of the measurement techniques utilized herein. Also, any numerical range recited herein is intended to include all sub-ranges of the same numerical precision subsumed within the recited range. Accordingly, Applicant reserves the right to amend this specification, including the claims, to expressly recite any sub-range subsumed within the ranges expressly recited herein.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific examples are disclosed only as illustrative embodiments. The scope of the technology is defined by the following claims and any equivalents thereof.

What is claimed is:

1. An upper garment, comprising:

a torso portion having a front side, a back side, a top end defining a boundary between the front and back sides, and a bottom end opposite to the top end;

a right sleeve attached to the torso portion;

a left sleeve attached to the torso portion;

a back-right stretch panel incorporated into the upper garment and positioned partially on the back side of the torso portion adjacent to where the right sleeve is attached to the torso portion, and extending onto the front side of the torso portion; and a back-left stretch panel incorporated into the upper garment, positioned at least partially on the back side of the torso portion adjacent to where the left sleeve is attached to the torso portion, spaced apart from the back-right stretch panel in the upper garment, and extending onto the front side of the torso portion, wherein each of the back-right and back-left stretch panels has a first edge facing a virtual back longitudinal center line extending along a longitudinal direction, and across a center, of the back side of the torso portion, and having a top point along the first edge that is closest to a top end of the torso portion defining a boundary between the front and back sides, wherein a distance between the top points of the first edges of the back-right and back-left stretch panels is greater than a minimum distance between the first edges of the back-right and back-left stretch panels, wherein the back-right stretch panel comprises:

a right back portion comprising the entire part of the back-right stretch panel that is on the back side of the torso portion; and a right extension portion comprising the entire part of the back-right stretch panel that is on the front side of the torso portion, wherein the bottom end defines an end of the upper garment, wherein the top end defines the entire boundary between the front and back sides that is between a neck opening of the upper garment and the right sleeve and the entire boundary between the front and back sides that is between the neck opening and the left sleeve, wherein the right back portion of the back-right stretch panel is positioned below, and spaced apart from, the top end of the torso portion, wherein the right back portion is larger than the right extension portion, and wherein a bottom edge of the back-right stretch panel defines a boundary between the back-right stretch panel and a first non-stretch panel, the first non-stretch panel extending from the bottom edge of the back-right stretch panel to the bottom end of the torso portion, a lowest portion along the bottom edge of the stretch panel being spaced apart from the bottom end of the torso portion by 25% to 45% of a maximum longitudinal length between the bottom end and the top end of the torso portion, and wherein the entire back-right stretch panel is on the torso portion, and a second non-stretch panel in the right sleeve has an edge extending along the entire boundary between the right sleeve and the torso portion, wherein the bottom edge of the back-right stretch panel extends from a first end on the back side of the torso portion, across the right boundary of the torso portion, and to a second end on the front side of the torso portion, and wherein a first distance between the bottom edge at the right boundary of the torso portion and the bottom end of the torso portion is greater than a second distance between the first end of the bottom edge and the bottom end of the torso portion.

2. The upper garment of claim 1, wherein the back-right and back-left stretch panels are symmetrical with respect to the virtual back longitudinal center line.

3. The upper garment of claim 1, wherein the first edges of the back-right and back-left stretch panels are curved convex towards the virtual back longitudinal center line, and wherein the minimum distance between the first edges of the back-right and back-left stretch panels is 10% to 30% of a maximum lateral width between first and second sides of the torso portion.

4. The upper garment of claim 1, wherein the bottom end of the torso portion defines a hem having a front portion corresponding to at least part of the front side of the torso portion and having:

a first end;

a second end;

a middle region between the first and second ends;

a first intermediate region between the first end and the middle region that extends farther downward along a longitudinal direction, relative to a virtual lateral line positioned on the front side of the torso portion between the bottom end and a top end of the torso portion, than each of the first end and the middle region; and a second intermediate region between the second end and the middle region that extends farther downward along the longitudinal direction, relative to the virtual lateral line, than each of the second end and the middle region.

5. The upper garment of claim 1, wherein the torso portion has a right side defining a right boundary between the front and back sides of the torso portion and a left side defining a left boundary between the front and back sides of the torso portion, wherein the first end and the second end are each spaced apart from the right boundary, wherein a third distance between the second end of the bottom edge and the bottom end of the torso portion is greater than the second distance, wherein the first edge of each of the back-right and back-left stretch panels has a bottom point that is closest to the bottom end of the torso portion, and a distance between the bottom points of the first edges of the back-right and back-left stretch panels is greater than the minimum distance between the first edges of the back-right and back-left stretch panels, wherein the minimum distance between the first edges of the back-right and back-left stretch panels is measured between interior-most points of the first edges, and a distance between the interior-most point of the first edge of the back-right stretch panel and the bottom end of the torso portion is 60% to 80% of the maximum longitudinal length, and wherein a distance between a top-most point of the right extension portion and the bottom end of the torso portion is 45% to 65% of the maximum longitudinal length.

6. A garment, comprising:

a torso portion having a front side and a back side;

a right sleeve comprising a right upper arm portion coupled to the torso portion and a right forearm portion coupled to the right upper arm portion;

a left sleeve comprising a left upper arm portion coupled to the torso portion and a left forearm portion coupled to the left upper arm portion;

a right-sleeve stretch panel incorporated into the garment, positioned at least partially on the right forearm portion, and shaped and sized to extend circumferentially at least partially around the right sleeve;

a first non-stretch panel incorporated into the garment, positioned on the right sleeve between the torso portion and the right-sleeve stretch panel, and joined to the right-sleeve stretch panel;

a second non-stretch panel incorporated into the garment, positioned on the right sleeve between the right-sleeve stretch panel and a right cuff of the right sleeve, and joined to the right-sleeve stretch panel; and a left-sleeve stretch panel incorporated into the garment, positioned at least partially on the left forearm portion, and shaped and sized to extend circumferentially at least partially around the left sleeve, wherein the right-sleeve stretch panel has a first edge proximal to the torso portion and extending circumferentially at least partially around the right sleeve, wherein a top line of the right sleeve extends between a distal end of the right sleeve and a top end of the torso portion, and a bottom line of the right sleeve extends between the distal end of the right sleeve and a right armpit portion of the garment, wherein a distance along the top line between the distal end of the right sleeve and the first edge of the right-sleeve stretch panel is less than a distance along the bottom line between the distal end of the right sleeve and the first edge of the right-sleeve stretch panel, wherein the right-sleeve stretch panel is entirely spaced apart from the distal end of the right sleeve, wherein a top portion of the right-sleeve stretch panel is entirely on the right forearm portion, the top portion of the right-sleeve stretch panel comprising the entire part of the right-sleeve stretch panel that is along the top line of the right sleeve, wherein the right-sleeve stretch panel has a second edge distal to the torso portion and extending circumferentially at least partially around the right sleeve, and wherein a distance along the top line between the distal end of the right sleeve and the second edge of the right-sleeve stretch panel is less than a distance along the bottom line between the distal end of the right sleeve and the second edge of the right-sleeve stretch panel.

7. The garment of claim 6, wherein the right-sleeve stretch panel has a closed-ribbon shape extending circumferentially entirely around the right sleeve.

8. The garment of claim 7, wherein an average width of the right-sleeve stretch panel, as measured along a longitudinal direction of the right sleeve between the first and second edges of the right-sleeve stretch panel, is 10% to 30% of a maximum length of the right sleeve.

9. The garment of claim 6, wherein at least a portion of the right-sleeve stretch panel extends simultaneously circumferentially around the right sleeve and longitudinally along the right sleeve.

10. The garment of claim 6, wherein a distance along the top line between the distal end of the right sleeve and the right-sleeve stretch panel is 5% to 15% of a length of the top line, and a distance along the bottom line between the distal end of the right sleeve and the right-sleeve stretch panel is 30% to 40% of a length of the bottom line.

11. The garment of claim 6, wherein the garment further comprises:

a back-right stretch panel incorporated into the garment and positioned at least partially on the back side of the torso portion adjacent to where the right sleeve is attached to the torso portion; and a back-left stretch panel incorporated into the garment, positioned at least partially on the back side of the torso portion adjacent to where the left sleeve is attached to the torso portion, and spaced apart from the back-right stretch panel in the garment.

12. The garment of claim 6, wherein a distance between the first and second edges of the right-sleeve stretch panel is constant along a circumferential direction.

13. The garment of claim 6, wherein a distance between the first and second edges of the right-sleeve stretch panel is variable along the circumferential direction such that the distance between the first and second edges of the right-sleeve stretch panel along the bottom line is greater than the distance between the first and second edges of the right-sleeve stretch panel along the top line.

* * * * *